US008507845B2

(12) United States Patent
Blick et al.

(10) Patent No.: US 8,507,845 B2
(45) Date of Patent: Aug. 13, 2013

(54) MEMBRANE DETECTOR FOR TIME-OF-FLIGHT MASS SPECTROMETRY

(75) Inventors: Robert Blick, Madison, WI (US); Jonghoo Park, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 0 days.

(21) Appl. No.: 13/484,560

(22) Filed: May 31, 2012

(65) Prior Publication Data

US 2012/0305760 A1 Dec. 6, 2012

Related U.S. Application Data

(60) Provisional application No. 61/492,445, filed on Jun. 2, 2011.

(51) Int. Cl.
*H01J 49/00* (2006.01)

(52) U.S. Cl.
USPC ..... 250/282; 250/281; 250/397

(58) Field of Classification Search
USPC ..... 250/281, 282, 283, 284, 287, 288, 250/307
See application file for complete search history.

(56) References Cited

U.S. PATENT DOCUMENTS

| | | | | |
|---|---|---|---|---|
| 3,624,390 | A * | 11/1971 | Watanabe | 250/310 |
| 4,060,823 | A | 11/1977 | Howorth et al. | |
| 4,303,930 | A | 12/1981 | Van Gorkom et al. | |
| 5,138,402 | A * | 8/1992 | Tsukamoto et al. | 257/471 |
| 5,227,628 | A | 7/1993 | Turner | |
| 5,814,832 | A | 9/1998 | Takeda et al. | |
| 5,994,694 | A | 11/1999 | Frank et al. | |
| 6,722,200 | B2 | 4/2004 | Roukes et al. | |
| 6,734,087 | B2 | 5/2004 | Hidaka et al. | |
| 7,388,201 | B2 | 6/2008 | Cholewa et al. | |
| 7,408,147 | B2 | 8/2008 | Blick et al. | |
| 7,884,324 | B2 | 2/2011 | Blick et al. | |
| 8,274,059 | B2 | 9/2012 | Blick | |
| 2002/0003210 | A1 * | 1/2002 | Marcus | 250/288 |
| 2002/0166962 | A1 | 11/2002 | Roukes et al. | |

(Continued)

FOREIGN PATENT DOCUMENTS

| | | |
|---|---|---|
| DE | 199 61 811 | 7/2001 |
| WO | WO 96/04676 | 2/1996 |

(Continued)

OTHER PUBLICATIONS

Aebersold et al. (Mar. 13, 2003) "Mass Spectrometry-Based Proteomics," *Nature* 422:198-207.

(Continued)

*Primary Examiner* — Robert Kim
*Assistant Examiner* — Jason McCormack
(74) *Attorney, Agent, or Firm* — Lathrop & Gage LLP

(57) ABSTRACT

The invention provides methods, and related devices and device components, for detecting, sensing and analyzing analytes in samples. In some aspects, the invention provides methods, and related devices and device components, useful in combination with a mass analyzer for the mass spectrometric analysis of analytes derived from biomolecules in biological samples including biological fluids cell extracts, and cell lysates. Methods of some aspects of the invention utilize a thin membrane-based detector as a transducer for converting the kinetic energies of analytes into a field emission signal via excitation of mechanical vibrations in an electromechanically biased membrane by generation of a thermal gradient.

25 Claims, 14 Drawing Sheets

(56) References Cited

U.S. PATENT DOCUMENTS

| | | | | |
|---|---|---|---|---|
| 2006/0214257 | A1 | 9/2006 | Ninomiya et al. | |
| 2007/0023621 | A1 | 2/2007 | Blick et al. | |
| 2007/0181799 | A1* | 8/2007 | Krogh et al. | 250/288 |
| 2008/0271778 | A1 | 11/2008 | Defries et al. | |
| 2009/0092862 | A1 | 4/2009 | Morris et al. | |
| 2009/0321633 | A1 | 12/2009 | Blick et al. | |
| 2010/0061513 | A1* | 3/2010 | Muto | 378/82 |
| 2010/0320372 | A1* | 12/2010 | Blick | 250/282 |

FOREIGN PATENT DOCUMENTS

| | | |
|---|---|---|
| WO | WO 02/12443 | 2/2002 |
| WO | WO 03/095616 | 11/2003 |
| WO | WO 03/095617 | 11/2003 |
| WO | WO 2004/041998 | 5/2004 |
| WO | WO 2007/016113 | 2/2007 |
| WO | WO 2007/094817 | 8/2007 |
| WO | WO 2010/151527 | 12/2010 |

OTHER PUBLICATIONS

Armour et al. (2002) "Transport Via a Quantum Shuttle," *Phys. Rev. B* 66:035333.

Ashcroft, A.E. (2003) "Protein and peptide identification: the role of mass spectrometry in proteomics," *Natural Product Reports*, 20(2):202-215.

Backmann, N., et al. (2005) "A label-free immunosensor array using single-chain antibody fragments," *Proc. Natl Acad. Sci. USA* 102, 14587-14952.

Bailer, M. K., et al. (2000) "A cantilever array-based artificial nose," *Ultramicroscopy* 82:1-9.

Barker et al. (2005) *Modern Microwave and Millimeter-Wave Power Electronics*, IEEE Press, Wiley, N.J., Ch. 4,7,8,15.

Beil et al. (2002) "p. 2-21: Broadband Acoustical Tuning of Nano-Electrochemical Sensors," *Proc. IEEE Sensor* 1:1285-1289.

Beil et al. (2003) "Comparing Schemes of Displacement Detection and Subharmonic Generation in Nanomachined Mechanical Resonators," *Nanotechnology*. 14:799-802.

Beuhler, R. J. et al. (1980) "Threshold studies of secondary electron emission induced by macro-ion impact on solid surfaces," *Nucl. Instrum. Methods* 170, 309-315.

Blick et al. (2003) "A Quantum Electromechanical Device: The Electromechanical Single-Electron Pillar," *Superlattices and Microstructures* 33(5-6):397-403.

Blick et al. (2004) "Nano-Electromechanical Transistor Operated as a Bi-Polar Current Switch," *Proceedings of the 4h IEEE Conference on Nanotechnology*, 258-259.

Blick et al. (Aug 15, 2002) "Nanostructured Silicon for Studying Fundamental Aspects of Nanomechanics," *J. Phys: Condens. Matter* 14:R905-R945.

Blick et al. (Dec. 25, 1995) "Photon-Assisted Tunneling Through a Quantum Dot at High Microwave Frequencies," *Appl. Phys. Lett.* 67(26):3924-3926.

Brattain et al. (Jan. 1953) "Surface Properties of Germainium," *Bell Syst. Tech. J.* 32:1-41.

Browning et al. (1993) "Atomic-Resolution Chemical Analysis Using a Scanning Transmission Electron Microscope," *Nature* 366:143-146.

Bruining, H. (1954) "Thin Film Field Emission," In; *Physics and Applications of Secondary Electron Emission*, McGraw-Hill Book Co., Inc., New York, 59-63.

Buldum et al. (Dec. 2003) "Electron Field Emission Properties of Closed Carbon Nanotubes," *Phys. Rev. Lett.* 91(23):236801.

Burg, T. P. et al. (2003) "Suspended microchannel resonators for biomolecular detection," *Appl. Phys. Lett.* 83, 2698-2700.

Burg, T. P., et al. (2007) "Weighing of biomolecules, single cells and single nanoparticles in fluid," *Nature* 446, 1066-1069.

Burg, T. P., et al. (Dec. 2006) "Vacuum-packaged suspended microchannel resonant mass sensor for biomolecular detection," *J. Microelectromech. Syst.* 15(6):1466-1476.

Chen, X., et al. (2003) "Mass spectrometric analysis of DNA mixtures: Instrumental effects responsible for decreased sensitivity with increasing mass," *Anal. Chem.* 75, 5944-5952.

Chiu, H.-Y., et al. (2008) "Atomic-scale mass sensing using carbon nanotube resonators," *Nano Lett.* 8, 4342-4346.

Cleland, A. N. (2005) "Thermomechanical noise limits on parametric sensing with nanomechanical resonators," *New J. Phys.* 7, 235.

Coon et al. (2005) "Tandem mass spectrometry for peptide and protein sequence analysis." *Biotechniques*, 38(4): 519, 521, 523.

Crewe et al. (Feb. 1969) "A Simple Scanning Electron Microscope," *Rev. Sci. Instrum.* 40(2):241-246.

Crewe et al. (Jun. 12, 1970) "Visibility of Single Atoms," *Science* 168:1338-1340.

Cruz et al. (2005) "Field Emission Characteristics of a Tungsten Microelectromechanical System Device," *Appl. Phys. Lett.* 86(153502):1-3.

Deshmukh et al. (Sep. 13, 1999) "Nanofabrication Using a Stencil Mask," *Appl. Phys. Lett.*75(11):1631-1633.

Domon et al. (2006) "Review—Mass spectrometry and protein analysis," *Science*, 312(5771): 212-217.

Driskill-Smith (Nov./Dec. 1997) "Fabrication and Behavior of Nanoscale Field Emission Structures," *J. Vac. Sci. Technol. B* 15(6):2773-2776.

Driskill-Smith et al. (Nov. 1, 1999) "The 'Nanotriode': A Nanoscale Field-Emission Tube," *Appl. Phys. Lett.* 75(18):2845-2847.

Driskill-Smith et al. (Nov. 24, 1997) "Nanoscale Field Emission Structures for Ultra-Low Voltage Operation at Atmospheric Pressure," *Appl. Phys. Lett.* 71(21):3159-3161.

Ekinci et al. (May 31, 2004) "Ultrasensitive Nanoelectromechanical Mass Detection," *Appl. Phys. Lett.* 84 (22):4469-4471.

Ekinci, K. L., et al.(2004) "Ultimate limits to inertial mass sensing based upon nanoelectromechanical systems," *J. Appl. Phys.* 95, 2682-2689.

Erbe et al. (Nov. 6, 2000) "Mechanical Mixing in Nonlinear Nanomechanical Resonators," *Appl. Phys. Lett.* 77(19):3102-3104.

Esposito, E., et al. (2002) "Fast Josephson cryodetector for time of flight mass spectrometry," *Physica C*, The Netherlands, 372-376:423-426.

Feng, et al. (2008) "A self-sustaining ultrahigh-frequency nanoelectromechanical oscillator," *Nature Nanotech.* 3, 342-346.

Fenn, J. B., et al. (1989) "Electrospray ionization for mass spectrometry of large biomolecules," *Science* 246, 64-71.

Forbes et al. (Mar./Apr. 1999) "Field-Emission: New Theory for the Derivation of Emission Area from a Fowler-Nordheim Plot," *J. Vac. Sci Technol. B* 17(2):526-533.

Forsen, E., et al. (2005) "Ultrasensitive mass sensor fully integrated with complementary metal-oxide-semiconductor circuitry," *Appl. Phys. Lett.* 87, 10 043507.

Fowler, R. H., et al. (1928) "Electron emission in intense electric fields," *Proc. R. Soc.* London, Ser. A 119:173-181.

Frank, M., et al. (1999) "Energy-sensitive cryogenic detectors for high-mass biomolecule mass spectrometry," *Mass Spectrom. Rev.* 18:155-186.

Fritz, J., et al. (2000) "Translating biomolecular recognition into nanomechanics," *Science*, 288:316-318.

Fursey, G. (2005) "Mass-Spectrometers with Field Emission Cathodes," *Field Emission in Vacuum Microelectronics*, Kluwer Academic/Plenum Publishers, New York, 159-160.

Geis et al. (Jun. 4, 1998) "A New Surface Electron-Emission Mechanism in Diamond Cathodes," *Nature* 393:431-435.

Geno, P. W. et al. (1989) "Secondary electron emission induced by impact of low-velocity molecular ions on a microchannel plate," *Int. J. Mass Spectrom. Ion Processes* 92, 195-210.

Gervasio, G. et al. (2000) "Aluminum junctions as macromolecule detectors and comparison with ionizing detectors," *Nucl. Instrum. Methods Phys. Res. A* 444, 389-394.

Gupta, A., et al. (Mar. 15, 2004) "Single virus particle mass detection using microresonators with nanoscale thickness," *Appl. Phys. Lett.* 84(11):1976-1978.

Hilton, G. C. et al. (Feb. 12, 1998) "Impact energy measurement in time-of-flight mass spectrometry with cryogenic microcalorimeters," *Nature* 391, 672-675.

Huang et al. (Jan. 30, 2003) "Nanoelectromechanical Systems: Nanodevice Motion at Microwave Frequencies," *Nature* 421:496.
Ibach, H. (1997) "The role of surface stress in reconstruction, epitaxial growth and stabilization of mesoscopic structures," *Surf. Sci. Reports* 29, 195-263.
Ilic et al. (Sep. 27, 2005) "Enumeration of DNA Molecules Bound to a Nanomechanical Oscillator," *Nano Lett.* 5(5):925-929.
Ilic, B., et al. (2004) "Attogram detection using nanoelectromechanical oscillators," *J. Appl. Phys.* 95(7)3694-3703.
Ilic, B., et al. (Apr. 1, 2004) "Virus detection using nanoelectromechanical devices," *Appl. Phys. Lett.* 85(13)2604-2606.
International Search Report and Written Opinion corresponding to application No. PCT/US12/40091, mailed Aug. 24, 2012.
International Search Report and Written Opinion, Corresponding to International Application No. PCT/US2006/28888, Mailed Jul. 11, 2008.
International Search Report and Written Opinion, Corresponding to International Application No. PCT/US2010/039451, Mailed Sep. 2, 2010.
Jensen et al. (Jul. 15, 1997) "Space Charge Effects on the Current-Voltage Characteristics of Gated Field Emitter Arrays," *J. Appl. Phys.* 82(2):845-854.
Jensen et al. (Jul./Aug. 1998) "Advanced Emitters for Next Generation of Amplifiers," *J. Vac. Sci. Technol. B* 16(4):2038-2048.
Jensen, K., et al. (Sep. 2008) "An atomic-resolution nanomechanical mass sensor," *Nature Nanotech.* 3, 533-537.
Johnson et al. (Feb. 15, 1954) "Secondary Electron Emission from Germanium," Phys. Rev. 93(4):668-672.
Kamiya et al. (Sep. 29, 1997) "Secondary Electron Emission from Boron-Doped Diamond Under Ion Impact: Applications in Single-Ion Detection," *Appl. Phys. Lett.* 71(13):1875-1877.
Kanter, H. (Feb. 1, 1961) "Energy Dissipation and Secondary Electron Emission in Solids," *Phys. Rev.* 121(3):677-681.
Karas, M. et al. (Oct. 15, 1988) "Laser desorption ionization of protein with molecular masses exceeding 10,000 Daltons," *Anal. Chem.* 60(20):2299-2301.
Kim et al. (Feb. 14, 2007) "Field Emission from a Single Nanomechanical Pillar," *Nanotechnology* 18(6):065201.
Kim et al. (Sep. 20, 2004) "Bonding Silicon-on-Insulator to Glass Wafers for Integrated Bio-electronic Circuits," *Appl. Phys. Lett.* 85(12):2370-2372.
Kirschbaum et al. (Jul. 8, 2002) "Integrating Suspended Quantum Dot Circuits for Applications in Nanomechanics," *Appl. Phys. Lett.* 81(2):280-282.
Koenig et al. (Jul. 5, 2004) "Drastic Enhancement of Nanoelectromechanical-System Fabrication Yield Using Electron-Beam Deposition," *Phys. Lett.* 85(1):157-159.
Koops et al. (Jan./Feb. 1988) "High-Resolution Electron-Beam Induced Deposition," *J. Vac. Sci. Technol. B* 6(1):477-481.
Koops et al. (Nov./Dec. 1996) "Conductive Dots, Wires, and Supertips for Field Electron Emitters Produced by Electron-Beam Induced Deposition on Samples Having Increased Temperature," *J. Vac. Sci. Technol. B* 14(6):4105-4109.
Kraus et al. (2000) "Nanomechanical Vibrating Wire Resonator for Phonon Spectroscopy in Liquid Helium," *Nanotechnol.* 11(3):165-168.
Lange, D., et al. (2002) "Complementary metal oxide semiconductor cantilever arrays on a single chip: mass-sensitive detection of volatile organic compounds," *Anal. Chem.* 74, 3084-3095.
Lassagne, B., et al. (2008) "Ultrasensitive mass sensing with a nanotube electromechanical resonator," *Nano Lett.* 8(11):3735-3783.
Lavrik, N. V. et al. (Apr. 21, 2003) "Femtogram mass detection using photothermally actuated nanomechanical resonators," *Appl. Phys. Lett.* 82(16):2697-2699.
Liu et al. (2000) "Optically Excited Electron Emission from Silicon Filed Emitter Arrays," Pacific Rim Conference on Lasers and Electro-Optics, *CLEO-Technical Digest*, 352-353.
Maier-Schneider, D., et al. (Dec. 1995) "A new analytical solution for the load-deflection of square membranes," *J. MEMS.* 4(4):238-241.
Mann et al. (2001) "Analysis of proteins and proteomes by mass spectrometry," *Annual Review of Biochemistry*, 70:437-473.
Meier, R. et al. (1993) "Velocity and ion species dependence of the gain of microchannel plates," *Int. J. Mass Spectrom. Ion Processes* 123, 19-27.
Molares et al. (Mar. 31, 2003) "Electrical Characterization of Electrochemically Grown Single Copper Nanowires," *Appl. Phys. Lett.* 82(13):2139-2141.
Moulin, A. M., et al. (1999) "Measuring Surface-Induced Conformational Changes in Proteins," *Langmuir* 15:8776-8779.
Naik, A. K., et al. (Jul. 2009) "Towards single-molecule nanomechanical mass spectrometry," *Nature Nanotech.* 4, 445-450.
Nguyen, C.T.-C. (Aug. 1999) "Frequency-Selective MEMS for Miniaturized Low-Power Communication Devices," *IEEE Trans. Microwave Theory Tech.* 47(8):1486-1503.
Nojeh et al. (Feb. 2006) "Ab Initio Modeling of the Interaction of Electron Beams and Single-Walled Carbon Nanotubes," *Phys. Rev. Lett.* 96:056802.
Ono, T., et al. (Mar. 2003) "Mass sensing of adsorbed molecules in sub-picogram sample with ultrathin silicon resonator," *Rev. Sci. Instrum.* 74(3)1240-1243.
Park, et al. (Aug. 2, 2011) "A Mechanical Nanomembrane Detector for Time-of-Flight Mass Spectrometry," *Nano Lett.*, 11 (9), 3681-3684.
Park, et al. (Jan. 25, 2012) "Quasi-dynamic mode of nanomembranes for time-of-flight mass spectrometry of proteins." *Nanoscale*, 4, 2543-2548.
Pescini et al. (1999) "Suspending Highly Doped Silicon-on-Insulator Wires for Applications in Nanomechanics," *Nanotechnol.* 10:418-420.
Pescini et al. (Dec. 3, 2001) "Nanoscale Lateral Field-Emission Triode Operating at Atmospheric Pressure," *Adv. Mater.* 13(23):1780-1783.
Pescini et al. (Jan. 20, 2003) "Mechanical Gating of Coupled Nanoelectromechanical Resonators Operating at Radio Frequency," *Appl. Phys. Lett.* 82(3):352-354.
Pescini, L. (May 8, 2003) "Electromechanical Coupling and Dissipation Mechanisms in Nanoscale Systems," Diploma Thesis, Ludwig-Maximilians-Universitat Munchen and Universitat degli Studi di Firenze.
Porter et al. (2001) "Laboratory Astrophysics Using an XRS Engineering Model Microcalorimeter," In *Low Temperature Detectors*, 9th International Workshop on Low Temperature Detectors, AIP Conference Proceedings, 605.
Roukes et al. (2000) "Nanoelectromechanical Systems," *Technical Digest of the 2000 Solid-State Sensor and Actuator Workshop* Hilton Head Island, SC, Jun. 4-8, 2000, 1-10.
Roukes, M.L. (2001) "Nanoelectromechanical Systems Face the Future," *Phys. World* 14:25-31.
Sato, T., et al. (1991) "Vibration of Beryllium foil window caused by plasma particle bombardment in plasma focus X-Ray source." *Jpn. J. Appl. Phys.* 30, 385-391.
Scheible et al. (2002) "Tunable Coupled Nanomechanical Resonators for Single-Electron Transport," *New J. Phys.* 4:86.1-86.7.
Scheible et al. (Aug. 1, 2004) "Effects of Low Attenuation in a Nanomechanical Electron Shuttle," *J. Appl. Phys.* 96(3):1757-1759.
Scheible et al. (Jun. 7, 2004) "Silicon Nanopillars for Mechanical Single-Electron Transport," *Appl. Phys. Lett.* 84(23):4632-4634.
Scheible et al. (May 12, 2003) "Dynamic Control of Coupled Nano-Mechanical Resonators," *Appl. Phys. Lett.* 82(19):3333-3335.
Scheible et al. (Oct. 25, 2004) "Periodic Field Emission from an Isolated Nanoscale Electron Island," *Phys. Rev. Lett.* 93(18):186801.
Scheible et al. (Sep. 2, 2002) "Evidence of a Nanomechanical Resonator Being Driven into Chaotic Response Via the Ruelle—Takens Route," *Appl. Phys. Lett.* 81(10):1884-1886.
Schossler et al. (Jul. Aug. 1997) "Conductive Supertips for Scanning Probe Applications," *J. Vac. Sci. Technol. B* 15(4):1535-1538.
Schossler et al. (Mar./Apr. 1998) "Nanostructured Integrated Electron Source," *J. Vac. Sci Technol. B* 16(2):862-865.
Seamster et al. (1977) "Silicon Detector DeltaE-E Particle Identification: A Theoretically Based Analysis Algorithm and Remarks on the Fundamental Limits to the Resolution of Particle Type by DeltaE-E Measurements," *Nuc. Inst. Meth.* 145:583-591.

Smirnov et al. (2003) "Nonequilibrium Fluctuations and Decoherence in Nanomechanical Devices Coupled to the Tunnel Junction," *Phys. Rev. B* 67:115312.
Spindt et al. (1998) "Field emitter array development for microwave applications II," *J. Vac. Sci. Technol*. B 16.2, 758-761.
Spindt et al. (May/Jun. 1996) "Field-Emitter-Array Development for Microwave Applications. II," *J. Vac. Sci. Technol. B* 14(3):1986-1989.
Spindt, C.A. (Jun. 1968) "A Thin-Film Field-Emission Cathode," *J. Appl. Phys*. 39:3504-3505.
Stab, L. (1990) "Thin Epitaxial Silicon Detectors," *Nuc. Inst. Meth. A* 288:24-30.
Tanaka, K. et al. (1988) "Protein and polymer analyses up to *m/z* 100,000 by laser ionization time-of-flight mass spectrometry." *Rapid Commun. Mass Spectrom*. 2, 151-153.
Roukes et al. (2000) "Nanoelectromechanical Systems," *Technical Digest of the 2000 Solid-State Sensor and Actuator Workshop* Hilton Head Island, SC, Jun. 4-Jun. 8, 2000, 1-10.
Teo et al. (Oct. 13, 2005) "Microwave Devices: Carbon Nanotubes as Cold Cathodes," *Nature* 437:968.
Thundat, T., et al. (1995) "Detection of mercury vapor using resonating microcantilevers," *Appl. Phys. Lett*. 66, 1695-1697.
Tilke et al. (May 26, 2003) "Fabrication and Transport Characterization of a Primary Thermometer Formed by Coulomb Islands in a Suspended Silicon Nanowire," *App. Phys. Lett*. 82(21):3773-3775.
Twerenbold et al. (1996) "Detection of Single Macromolecules Using a Cryogenic Particle Detector Coupled to a Biopolymer Mass Spectrometer," *Applied Physics Letters*, 68:3503-3505.
Twerenbold, D. et al. (2001) "Single molecule detector for mass spectrometry with mass independent detection efficiency," *Proteomics* 1, 66-69.
Weber et al. (Mar./Apr. 1995) "Electron-Beam Induced Deposition for Fabrication of Vacuum Field Emitter Devices," *J. Vac. Sci. Technol. B* 13(2):461-464.
Westmacott, G., et al. (1996) "Secondary ion and electron yield measurements for surfaces bombarded with large molecular ions," *Nucl. Instrum Methods Phys. Res. B* 108, 282-289.
Westmacott, G., et al. (2000). "Using a superconducting tunnel junction detector to measure the secondary electron emission efficiency for a microchannel plate detector bombarded by large molecular ions," *Rapid Commun. Mass Spectrom*. 14, 1854-1861.
Whaley et al. (Jun. 2002) "Experimental Demonstration of an Emission-Gated Traveling-Wave Tube Amplifier," *IEEE TOPS* 30(3):998-1008.
Wilcock et al. (Feb. 6, 1960) "An Image Intensifier with Transmitted Secondary Electron Multiplication," *Nature* 185:370-371.
Wiley, W. C. et al. (1955) "Time-of-flight mass spectrometry with improved resolution," *Rev. Sci. Instrum*. 26(12):1150-1157.
Wong et al. (1993) "Observational of Fowler-Nordheim Tunneling at Atmospheric Pressure Using Au/Ti Lateral Tunnel Diodes," *J. Phys. D* 26:979-985.
Xu et al. (Dec. 21, 1998) "Enhancing Electron Emission from Silicon Tip Arrays by Using Thin Amorphous Diamond Coating," *Appl. Phys. Lett*. 73(25):3668-3670.
Yamashita et al. (Nov./Dec. 2000) "High-Performance Membrane Mask for Electron Projection Lithography," *J. Vac. Sci. Technol. B* 18(6):3237-3241.
Yates. (1998) "Mass Spectrometry and the Age of the Proteome," *J. Mass Spectrometry*, vol. 33, 1-19.
Zheng et al. (Mar. 12, 2004) "Quantum-Mechanical Investigation of Field-Emission Mechanism of a Micrometer-Long Single-Walled Carbon Nanotube," *Phys. Rev. Lett*. 92(10)106803.

* cited by examiner

MEMBRANE DETECTOR FOR TIME-OF-FLIGHT MASS SPECTROMETRY

CROSS-REFERENCE TO RELATED APPLICATIONS

This application claims the benefit of priority under 35 U.S.C. 119(e) to U.S. Provisional Patent Application 61/492,445 filed Jun. 2, 2011, which is hereby incorporated by reference in its entirety to the extent not inconsistent with the disclosure herein.

STATEMENT REGARDING FEDERALLY SPONSORED RESEARCH OR DEVELOPMENT

This invention was made with government support under FA9550-08-1-0337 awarded by the USAF/AFOSR. The government has certain rights in the invention.

BACKGROUND OF INVENTION

Over the last several decades, mass spectrometry has emerged as one of the most broadly applicable analytical tools for the detection and characterization of a wide class of molecules. Mass spectrometric analysis is applicable to almost any chemical species capable of forming an ion in the gas phase, and, therefore, provides perhaps the most universally applicable method of quantitative analysis. In addition, mass spectrometry is a highly selective technique especially well-suited for the analysis of complex mixtures comprising different compounds in varying concentrations. Further, mass spectrometric analysis methods can provide detection sensitivities approaching tenths of parts per trillion for some analytes. As a result of these attributes, a great deal of attention has been directed over the last several decades at developing mass spectrometric methods for analyzing biomolecules, such as peptides, proteins, lipids and oligonuceotides in biological samples.

Mass spectrometric analysis involves three fundamental processes: (1) gas phase ion formation, (2) mass analysis whereby ions are separated on the basis of mass-to-charge ratio (m/z), and (3) detection of ions subsequent to separation. The overall efficiency of a mass spectrometer (overall efficiency=(analyte ions detected)/(analyte molecules consumed)) may be defined in terms of the efficiencies of each of these fundamental processes by the equation:

$$E_{MS}=E_F\times E_{MA}\times E_D, \quad (I)$$

wherein:

$E_{MS}$ is the overall efficiency;

$E_F$ is the ion formation efficiency=(analyte ions formed)/(analyte molecules consumed during ion formation), $E_{MA}$ is the mass analysis efficiency=(analyte ions mass analyzed)/(analyte ions consumed during analysis), and $E_D$ is the detection efficiency=(analyte ions detected)/(analyte ions consumed during detection).

Despite wide adoption of mass spectrometry for identifying and characterizing biomolecules, conventional state of the art mass spectrometers have surprisingly low overall efficiencies for these compounds. For example, a quantitative evaluation of the efficiency of a conventional orthogonal injection time-of-flight mass spectrometer (Perseptive Biosystems Mariner) for the analysis of a sample containing a 10 kDa protein yields the following efficiencies, $E_S=1\times10^{-4}$, $E_{MA}=8\times10^{-7}$ and $E_D=9\times10^{-3}$, providing an overall efficiency of the mass spectrometer of 1 part in $10^{12}$. As a result of low overall efficiency, conventional mass spectrometric analysis of biomolecules typically requires large samples and is unable to achieve the ultra-low sensitivity needed for many important biological applications, such as single cell analysis of protein expression and post-translational modification. Therefore, there is a significant need in the technical field for more efficient ion preparation, analysis and detection techniques to enhance the utility of mass spectrometric analysis for target applications in biology and biochemistry.

Over the last decade, new ion preparation methods have revolutionized mass spectrometric analysis of biological molecules. These new ionization methods, which include matrix assisted laser desorption and ionization (MALDI) and electrospray ionization (ESI), provide greatly improved ionization efficiency for a wide range of compounds having molecular weights up to several hundred KiloDaltons. Moreover, MALDI and ESI ionization sources have been successfully integrated with a wide range of mass analyzers, including quadrupole mass analyzers, time-of-flight instrumentation, magnetic sector analyzers, Fourier transform—ion cyclotron resonance instruments and ion traps, to provide selective identification of polypeptides and oligonucleotides in complex mixtures. Mass determination by time-of-flight (TOF) analysis has proven especially well-suited for the high molecular weight biomolecules ionized by ESI and MALDI techniques because TOF has no intrinsic limit to the mass range accessible, provides high spectral resolution and has fast temporal response times. Use of time-of-flight mass analysis with ESI and MALDI ion sources for proteomic analysis is described in detail by Yates in Mass Spectrometry and the Age of the Proteome, Journal of Mass Spectrometry, Vol. 33, 1-19 (1998). As a result of these advances, MALDI-TOF and ESI-TOF have emerged as the two most commonly used ionization techniques for analyzing complex samples containing biomolecules.

Although integration of modern ionization techniques and time-of-flight analysis methods has expanded the mass range accessible by mass spectrometric methods, complementary ion detection methods suitable for time of flight analysis of high molecular weight compounds, including many biological molecules, remain considerably less well developed. Indeed, effective upper limits of mass ranges accessible by state of the art MALDI-TOF and ESI-TOF analysis techniques are limited by the sensitivity of conventional ion detectors for high molecular weight ions. Conventional multichannel plate (MCP) detectors, for example, exhibit sensitivities that decrease with ion velocity, which in the context of time of flight analyzers corresponds to a decrease in sensitivity with increasing molecular weight.

MCP detectors are perhaps the most pervasive ion detectors currently used in ESI-TOF and MALDI-TOF mass spectrometry. These detectors operate by secondary electron emission and typically comprise a parallel array of miniature channel electron multipliers. Typically the channel diameters are in the range of 10 to 100 microns with the lengths of the channels in the neighborhood of 1 mm. Each channel operates as a continuous dynode structure, meaning that it acts as its own dynode resistor chain. A potential of about 1 to 2 kV is placed across each channel. When an energetic, ionized molecule enters the low potential end of the channel and strikes the wall of the channel it produces secondary electrons which are in turn accelerated along the tube by the electric field. These electrons then strike the wall generating more electrons. The process repeats many times until the secondary electrons emerge from the high potential end of the channel. Generally speaking for each molecule which initiates a cascade, $10^4$ electrons emerge from the channel providing significant gain. The electron cascade formed is collected at an anode and generates an output signal. MCP detectors can be made in large area format which is useful for analysis of packets of ions in TOF systems.

A number of limitations of MCP detection systems arise out of the impact-induced mechanism governing the generation of secondary electrons. First, the yield of secondary electrons in a MCP detector decreases significantly as the velocities of ions colliding with the surface decreases. As time-of-flight detectors accelerate all ions to a fixed kinetic energy, high molecular weight ions have lower velocities and, hence, lower probabilities of being detected by MCP detectors. Second, the secondary electron yield of MCP detectors also depends on the composition, size and structure of colliding gas phase ions. Third, it is also established that once a cascade has been initiated within a channel, it is depleted of electrons. Due to the high resistivity of the channel, the time required to replace these electrons is several orders of magnitude larger (milliseconds) than the duration of the TOF measurement (microseconds). Thus, for a single TOF event a channel is rendered inactive ("deadtime") after a single cascading event, thus each successive packet of ions impinging on the detector has fewer and fewer active channels available to it.

As apparent to those skilled in the art of mass spectrometry, these limitations impact the utility of MCP detectors for certain mass spectrometry applications by hindering quantitative analysis of samples containing high molecular weight biopolymers. Accordingly, a need currently exists for ion detectors for mass spectrometry that do not exhibit decreasing sensitivities with increasing molecular weight and that do not have sensitivities dependent on the composition and structure of gas phase ions analyzed.

U.S. Patent Publication No. 2007/0023621, published Feb. 1, 2007, U.S. Patent Publication No. 2009/0321633, published Dec. 31, 2009, and U.S. Patent Publication No. 2010-0320372, published Dec. 23, 2010, disclose detectors for mass spectrometry having a nano- or microstructured membrane geometry. In these systems, impact of ions on a receiving surface of an electrically biased semiconductor membrane generates field emission from the membrane. The references provide modeling data and experimental results showing that measurement of field emission from the membrane as a function of time provides a means for detecting and analyzing ions, for example, by determination of the flight times of ions separated on the basis of mass to charge exiting a time of flight analyzer.

It will be appreciated from the foregoing that there is currently a need in the art for methods, systems and devices for detecting and analyzing molecules having large molecular masses. Specifically, detection methods and systems providing sensitive detection of large molecular mass molecules are needed that are capable of effective integration with conventional mass spectrometry systems, such as TOF analysis systems. Sensors and analyzers are needed for mass spectrometry applications that do not exhibit decreases in sensitivity as a function of molecular mass, and that are capable of fast readout and good temporal resolution.

SUMMARY OF THE INVENTION

The invention provides methods, and related devices and device components, for detecting, sensing and analyzing analytes in samples. In some aspects, the invention provides methods, and related devices and device components, useful in combination with a mass analyzer for the mass spectrometric analysis of analytes derived from biomolecules in biological samples including biological fluids, cell extracts, cell lysates, and small viruses & mutants. Methods of some aspects of the invention utilize a thin membrane-based detector as a transducer for converting the kinetic energies of analytes into a field emission signal via excitation of mechanical vibrations in an electromechanically biased membrane by generation of a thermal gradient. The invention also provides methods for analyzing the field emission output of a thin membrane-based detector to provide measurements of the flight times, abundance, mass-to-charge ratios, molecular mass and/or composition of analytes comprising ions separated on the basis of mass-to-charge ratio by a mass analyzer.

Detectors of the present invention provide high detection sensitivities over a useful range of molecular masses ranging from a few Daltons up to 10 s of megadaltons. In some embodiments, the present methods and systems achieve useful detection sensitivities that do not significantly vary as a function of velocity or molecular mass, in contrast to many conventional MCP detectors. In some embodiments, methods, devices and device components of the present invention provide for the detection ions derived from a range of molecules, including biomolecules such as proteins, peptides and oligonucleotides. In some embodiments, the present methods and systems provide for the detection of analytes with good temporal resolution and sensitivity, and therefore, are well suited for mass spectrometry applications including proteomics, micro-array analysis and the identification of biomarkers. In some embodiments, the present systems and methods provide a versatile detection platform compatible with a range of state of the art ionization systems, including MALDI and ES ionization systems, and mass analyzers, including time-of-flight mass analyzers, quadrupole analyzers and ion trap analyzers.

In an aspect, the invention provides a method of detecting analytes, the method comprising: a) providing a detector comprising: a membrane having a receiving surface for receiving the analytes, and an internal surface positioned opposite to the receiving surface, wherein the membrane is a material selected from the group consisting of a semiconductor, a metal and a dielectric material, and wherein the membrane has a thickness selected from the range of 5 nanometers to 50 microns; a holder for holding the membrane, wherein said holder contacts said membrane at one or more contact points; an extraction electrode positioned so as to establish an applied electric field on the internal surface of the membrane or an electron emitting layer provided on the internal surface of the membrane, thereby causing emission of electrons from the internal surface or the electron emitting layer; and an electron detector positioned to detect at least a portion of the electrons emitted from the internal surface or the electron emitting layer; b) generating a non-uniform temperature distribution along a thickness dimension, lateral dimension, vertical dimension or any combination of these of the membrane by contacting the receiving surface with the analytes, thereby exciting a mechanical deformation of the membrane that modulates the emission of electrons from the internal surface of the membrane or the emitting layer; and c) detecting the electrons emitted from the internal surface of the membrane or the emitting layer. In an embodiment, the membrane is in an electromechanically biased state provided by the holder and extraction electrode. The extraction electrode of the current invention may optionally be a gating electrode. As used herein, the term "electromechanically biased" refers to a combination of voltage biasing and mechanical biasing. In an embodiment, for example, the extraction electrode provides standard voltage biasing and the holder provides built in strain within the membrane, providing a configuration which can lead to a 'bulging' in one or the other direction, which effectively shows up as a field emission current modulation. In an embodiment, the membrane is an overdamped oscillator due to the contact points provided by the holder, for example, an overdamped harmonic oscillator. In an embodiment, the method of the invention further comprises the step of generating analytes comprising ions from a sample containing biomolecules. In an embodiment, the method of the invention further comprises the step of spatially separating packets of the analytes on the basis of mass-to-charge ratio prior to contact with the receiving surface of the membrane.

In an embodiment, electrons are emitted from the internal surface of the membrane, or an electron emitting layer provided thereon, via field emission, for example, via field emission generated by the electrical biasing of the membrane and/or emitting layer provided by the extraction electrode. In an embodiment, electrons emitted from the membrane or emitting layer are detected in real time, for example, to provide measurement of a temporal profile of the field emission before, during and after impact of the analyte on the receiving surface. In an embodiment, the emission of electrons from the internal surface of the membrane, or an electron emitting layer provided thereon, varies as a function of time as a result of mechanical deformation and excitation of vibration of the membrane. In an embodiment, detection of field emission from the membrane and/or emitting layer provides an output signal that is subsequently analyzed to provide one or more measurement of a characteristic of the analytes, such as the flight time, intensity, mass-to-charge ratio, and/or composition of the analyte.

In some methods of the invention, generation of a non-uniform temperature distribution by contact of an analyte(s) with the membrane achieves a selective modulation of the field emission from the membrane so as to provide a detection sensitivity that is substantially independent of the velocity or mass of analytes contacting the receiving surface. As used here, a "non-uniform temperature distribution" refers to temperatures that vary within, or across, the membrane and/or on a surface of the membrane, and optionally a variation in temperature on, or within, the membrane that exceeds thermal fluctuation of ambient temperature. In some embodiments, for example, an increase in the local temperature of the membrane, or a portion thereof, is induced by impact of an ion, or packet of ions, on the receiving surface of the membrane. In some embodiments, the increase in temperature is proportional to the kinetic energy of analytes contacting the receiving surface and/or the acceleration voltage of analytes separated on the basis of mass-to-charge ratio.

In some embodiments, generation of a non-uniform temperature distribution, such as a thermal gradient, in or on the membrane, results in thermomechanical forces that provides deformation and excitation of a vibration of the membrane. The invention includes methods and systems wherein a plurality of vibrations (or a plurality of different vibrational modes) is excited by the non-uniform temperature distribution in, or on, the membrane. The vibration(s) excited by the non-uniform temperature distribution modulates the distance between the internal surface of the membrane and the extraction electrode, thereby changing the electrical biasing of the membrane as a function of time. Accordingly, the intensity of electrons emitted from the internal surface, or emitting layer provided thereon, changes as the vibration is excited and subsequently rings down in the membrane. The time evolution of the emission, therefore, is used in some of the present methods to detect and provide a measurement of a characteristic of the analytes.

In an embodiment, the non-uniform temperature distribution is established along one or more thickness dimension, lateral dimension, vertical dimension, or any combination of these dimensions of the membrane. In an embodiment, for example, the non-uniform temperature distribution is along at least a portion of the thickness of the membrane, for example, along at least a portion of a thickness dimension of the membrane along an axis that intersects the receiving surface, the internal surface or both the receiving surface and the internal surface. In an embodiment, for example, the non-uniform temperature distribution is along one or more lateral dimensions, vertical dimensions or any combination of lateral dimensions and vertical dimension of the membrane. As used herein, lateral and vertical dimensions refer to axis on or within the membrane that are orthogonal to the thickness dimension, for example, axis that are parallel to at least a portion of the plane of the receiving surface, the internal surface or both the receiving surface and the internal surface. In an embodiment, a lateral dimension is a length and a vertical dimension is a height. In an embodiment, for example, the non-uniform temperature distribution extends to one or more contact points or a region of the membrane within 100 nanometers of a contact point(s), and optionally a region of the membrane within 20 nanometers of a contact point(s). In an embodiment, for example, the non-uniform temperature distribution increases the temperature of the membrane at one or more of the contact points or a region of the membrane within 100 nanometers of a contact point(s)), and optionally a region of the membrane within 20 nanometers of a contact point(s). In an embodiment, for example, the non-uniform temperature distribution extends to one or more edges of the membrane, for example, edges of the membrane proximate (e.g. within 100 nm or within 20 nm) to the contact points with the holder.

In some of the present methods, a non-uniform temperature distribution is generated having a magnitude sufficient to excite and/or establish a mechanical deformation of the membrane useful for generating a field emission signal for detecting and analyzing analytes. In an embodiment, for example, the mechanical deformation of the membrane is a nonstatic deformation. In an embodiment, for example, the mechanical deformation of the membrane is an elastic deformation. In an embodiment, for example, the non-uniform temperature distribution is greater than the average thermal fluctuation at a temperature of 298 K. The non-uniform temperature distribution of the membrane can be characterized in some embodiments as a thermal gradient that is a function of time, a function of position within, or on, the membrane, or as a function of both the time and position within, or on, the membrane. In some embodiments, for example, the non-uniform temperature distribution is characterized by a thermal gradient greater than or equal to 90K/nm, optionally greater than or equal to 250 K/nm. In some embodiments, for example, the non-uniform temperature distribution is characterized by a thermal gradient selected over the range of 90K/nm to 910K/nm, optionally selected over the range of 200K/nm to 600K/nm. In some embodiments, for example, the non-uniform temperature distribution is characterized by an increase in temperature at a rate greater than or equal to $7.9\times10^{12}$K/sec, and optionally an increase in temperature at a rate selected over the range of $7.9\times10^{12}$K/sec to $8.03\times10^{13}$K/sec, and optionally an increase in temperature at a rate selected over the range of $1.5\times10^{13}$K/sec to $5\times10^{13}$K/sec. In an embodiment, the maximum membrane temperature is as large as 1200K, and optionally the maximum membrane temperature is selected over the range of 700 to 800K.

In some embodiments, the non-uniform temperature distribution is characterized by a maximum temperature of the membrane or portion thereof, at some point during or after the analyte comes in contact with the receiving surface. In some embodiments, for example, the maximum temperature of the membrane is less than the melting point temperature of the electron emitting layer and/or the membrane so as to avoid degradation of the detector during measurement. In some embodiments, the maximum temperature of the membrane is equal to 1415° C., and optionally for some applications 3550° C. In an embodiment, for example, the temperature at the moment of impact with the receiving surface within the phonon and electron mean free path is higher than the equilibrium temperature of the membrane or an absorber layer provided on the membrane.

In some of the present methods, a non-uniform temperature distribution is generated having selected spatial properties for exciting and/or establishing a mechanical deformation useful for generating a field emission signal for detecting and analyzing analytes. In some embodiments, for example, the non-uniform temperature distribution is characterized by a thermal gradient extending a distance in the membrane selected from the electron and phonon mean-free path to the entire thickness of the membrane. In some embodiments, for example, the non-uniform temperature distribution is characterized by a thermal gradient extending a distance of $1\times 10^{-3}$% to 100% of the thickness of the membrane, optionally for some embodiments 0.1 to 100% and optionally for some embodiments 1 to 100% of the thickness of the membrane. In some embodiments, for example, the non-uniform temperature distribution is characterized by a thermal gradient extending a distance of 3 nm to 50 μm along the thickness of the membrane and optionally for some embodiments a distance of 100 nm to 50 μm along the thickness of the membrane.

In some methods of the invention, the mechanical deformation of the membrane excites a mechanical vibration of the membrane, for example, resulting in mechanical vibration of the membrane in a manner that selectively changes the distance between the internal surface, or an emitting layer provided thereon, and the extraction electrode. This mechanical vibration is capable, therefore, of changing as a function of time the electric potential on the internal surface, or an emitting layer provided thereon, thereby resulting in selective modulation of the intensity of field emission. In an embodiment, for example, the mechanical vibration changes a distance separating the internal surface from the extraction electrode as a function of time. In an embodiment, for example, the internal surface or electron emitting layer in an original state and the extraction electrode are separate by a separation distance, wherein the mechanical vibration is characterized by a change of position of the membrane from an original state up to the separation distance between the electron emitting layer in the original state and the extraction electrode. In an embodiment, for example, the mechanical vibration is characterized by a change of position from an original state of the membrane to a distance between the original state of the membrane and the extraction electrode, for example, a distance selected over the range of 0.1 μm to 127 μm. In an embodiment, the mechanical vibration is characterized by a periodic oscillation of the membrane, for example, a harmonic oscillation. In an embodiment, the mechanical vibration is a periodic oscillation having a frequency selected over the range of 1 MHz to 100 MHz, and optionally for some applications selected over the range of 1 kHz to 10 GHz.

The methods of the invention may further comprise a number of additional steps prior to contacting the receiving surface. Optional steps of the present methods include purification of analyte in a sample, for example, via chromatographic separation, prior to contacting the receiving surface. Optional steps of the present methods include generation of an analyte comprising analyte ions, for example, via electrospray ionization or MALDI techniques, prior to contacting the receiving surface of the membrane. Optional steps of the present methods include separating the analytes on the basis of mass-to-charge ratio prior to contacting the receiving surface, for example, by providing the analytes to a mass analyzer prior to contacting the receiving surface of the membrane. Optional steps of the present methods include passing the analytes through a flight tube to achieve physical separation of packet of analytes comprising ions on the basis of mass-to-charge ratio prior to contacting the receiving surface of the membrane. Optional steps of the present methods include accelerating the analytes so the analytes have a preselected average kinetic energy upon contacting the receiving surface of the membrane, such as a preselected average kinetic energy selected over the range of 0.1 keV-100 keV.

In some aspects, the methods of the invention further comprise the step of measuring and analyzing the field emission from the membrane as a function of time to determine a characteristic of the analytes, such as intensity, amount, mass-to-charge ratio, molecular mass and/or composition. The present methods include, measurement and analysis of a temporal profile of the field emission, for example, by measuring the intensity of field emission from the membrane or emitting layer as a function of time. The present methods include analysis of the temporal profile of the emission to identify and/or characterize one or more peak, maximum value, full width at half maximum, slope, leading edge, integrated intensity or combination of these corresponding to a feature (e.g., peak, etc.) in the temporal profile of electron emission.

A specific method of the invention, for example, further comprises measuring intensities of the electrons emitted from the membrane or emitting layer as a function of time, thereby generating a response signal characterized by one or more peaks at different times, wherein each peak is characterized by a maximum value. In an embodiment, for example, the response signal characterized by one or more peaks at different times, and optionally characterized by a series of peaks. In an embodiment, for example, the method further comprises the steps of: (1) identifying a peak corresponding to an earliest time, such as the first peak in a response signal; and (2) determining the maximum value corresponding to the identified peak, such as the first peak. In an embodiment, the term "peak" refers to a peak in the temporal profile of electron emission. In an embodiment, for example, the peak refers to the oscillation peak of the membrane which modulates the intensity of field emission. In an embodiment, for example, the maximum value determined is proportional to the amount of the analytes contacting the receiving surface of the membrane. As used herein, the term "amount" refers to the intensity, concentration or number of analytes contacting the receiving surface. In an embodiment, for example, the maximum value is proportional to the kinetic energy of the analytes contacting the receiving surface of the membrane. In an embodiment, for example, the present methods further comprise the step of determining a detection time corresponding to the maximum value, wherein the detection time is proportional to a flight time of the analytes. In some embodiments, for example, the flight time of the analytes is further analyzed to determine the mass-to-charge ratio and/or composition of the analytes.

A specific method of the invention further comprises the step of determining a width of the first peak, wherein the width can be related to a measurement of a characteristic of the vibration(s) of the membrane excited by the non-thermal distribution and, in some instances, the thermal background noise. In some embodiments, the width corresponds to half of a period (1/frequency) of the oscillation (e.g., mechanical vibration) of the membrane. The characteristic frequency may be determined by the geometry of the membrane, such as thickness, side length, and stretching force along the membrane edge, and the thickness and Young's modulus (i.e. material parameters), and it is noted that more than one vibrational mode can be excited in methods of the invention.

A specific method of the invention further comprises the step of determining a slope of a feature in the temporal profile of the emission, for example, a slope corresponding to the leading edge of the ion packet. In some embodiments, for example, the slope corresponds to a measurement of the amount of the analytes contacting the receiving surface and mass broadening due to an isotope distribution of the analytes. In an embodiment, the slope of the leading edge of the ion packet may be determined by the number of ions in an ion packet and the mass broadening due to isotope distribution. The number of ions in an ion packet, for example, may be a function of the laser intensity and molar concentration of the protein sample.

The physical dimensions, composition and physical properties of the membrane are selected in some methods and systems so that it can efficiently couple the kinetic energy of the analytes into vibration of the membrane via formation of a non-uniform temperature distribution. Preferably for some applications, the membrane is able to achieve a high conversion efficiency of kinetic energy from molecules contacting the membrane to thermal energy capable of exciting vibration(s) in the membrane. Use of semiconductor membranes is beneficial for some embodiments so as to provide mechanical and electronic properties useful for generation of field emission in the present methods and systems. In an embodiment, for example, the membrane comprises a semiconductor material, such as a single crystalline semiconductor material and/or a doped semiconductor material. In an embodiment, for example, the membrane comprises a metal. In an embodiment, for example, the membrane comprises a material selected from the group consisting of an elemental semiconductor, II/V semiconductor, a III/V-semiconductor and any combinations thereof. In an embodiment, for example, the membrane comprises one or more materials selected from the group consisting of Si, Ge, $Si_3N_4$, diamond, graphene, Al, Ga, In, As and any combinations thereof. In some embodiments, for example, the membrane comprises one or more materials selected from the 3rd and 5th columns of the periodic table of elements. Although, their processing routines are a bit different, use of III/V semiconductor materials provides important benefits including: (i) these so-called III/V-nanomembranes are optically active, i.e. under proper electrical bias conditions they can send out visible light, and (ii) these materials are also piezoelectric, i.e. an applied voltage can lead to a mechanical displacement of the nanomembrane. The piezoelectric aspect enables, for example, in-situ fine-tuning of the biasing point for field emission. An optically active nanomembrane has the advantage that field emission is no longer required. Instead the impact of ions on one side of the nanomembrane detector stimulates light emission on the other side. This light will be similar in wavelength distribution as what is obtained from classical LEDs. For appropriately designed nanomembranes coherent light emission can also be obtained.

In an embodiment, for example, the membrane has a thickness dimension, such as an average thickness over the active area, less than or equal to 10 microns, optionally for some applications less than or equal to 1 micron. In an embodiment, for example, the membrane comprises a plurality of layers of one or more semiconductor materials, wherein each of the layers have thicknesses selected over the range of 5 nm to 50 μm. Additionally, the semiconductor membrane may comprise an alternating sequence of layers comprising the same or different semiconductor materials, wherein the sequence comprises two or more layers. In one embodiment, each layer of the semiconductor membrane comprises a single crystalline material. Optionally, the semiconductor membrane further comprises a protective layer provided on the external surface. The protective layer is preferably a thin metallic layer having a thickness of 5 nanometers to 25 nanometers that prevents charging effects of low-conductivity semiconductor materials such as SiN.

Preferably for some applications, the membrane has a receiving surface characterized by a high accommodation coefficient for the analytes, such as an accommodation coefficient selected over the range of $1\times10^{-4}$ to 1. In one embodiment, the receiving surface of the membrane is functionalized or derivatized to provide high surface accommodation of molecules subject to detection and/or analysis. For example, the receiving surface may be coated with a thin layer of a material, such as gold, that increases the accommodation coefficient of the receiving surface with respect to a broad class of molecules. Alternatively, the receiving surface may be functionalized in a manner providing selective accommodation characteristics, such as providing a large accommodation for specific molecules and a low accommodation coefficient for other species. For example, biological molecules, such as proteins and/or oligonucleotides, may be bound to the receiving surface in a manner retaining their biological activities so as to provide a probe for identifying molecules that selectively interact with the surface bound biological molecules. In some applications of the present invention, functionalization or derivization of the membrane surface does not significantly disrupt or affect the mode structure and resonance frequencies of the resonators mechanically coupled to the inner surface of the membrane. Increasing accommodation of the receiving surface may also be accomplished in the present invention by holding the receiving surface at low temperatures.

In an embodiment, for example, the detector further comprises an absorber layer provided on the receiving surface of the membrane such that the analytes contact the absorber layer, so as to generate the non-uniform temperature distribution in or on the membrane. The composition and physical dimensions of the absorber layer may be selected to enhance conversion of kinetic energies of analytes into thermal energy for establishing a non-uniform temperature distribution useful for detection and characterization of analytes. In an embodiment, for example, the absorber layer has a thickness less than the thickness of the membrane. In an embodiment, for example, the absorber layer has a thickness selected over the range of 1 nm to 50 nm. In an embodiment, for example, the absorber layer comprises a metal.

In an embodiment, the internal side of the membrane, or an emitting layer provided thereon, is characterized as a rough surface. Methods and systems using such a rough surface of this aspect are beneficial for some applications by providing useful field emission properties. In an embodiment, the internal surface of the membrane is a rough surface having a plurality of nanostructures, for example, nanostructures having aspect ratios selected over the range of 0.1 to 1000.

Membranes useful in the present methods and systems may have morphologies, size and shape selected for a given application. In some embodiments, for example, the membrane is characterized by a large active detection area, for example, a receiving surface having an active area of 0.5 $mm^2$ to 15 $cm^2$. Optionally, the detectors of the present invention comprise a substrate having one or more active detector areas able to receive a molecule, where each active detector area comprises a membrane and emitting layer. The membrane for each active area can be selected or manipulated to be sensitive for a specific molecule mass. The active areas of the detector can be made sensitive to the same molecular mass or different molecular masses compared to one another. Preferably, each active area has a surface area between 0.1 $millimeters^2$ to 202 $centimeters^2$. The methods and systems of the invention are compatible with use with a single pixel (i.e. membrane) or a plurality of pixels. Alternatively, each active area can have a surface area smaller than 0.1 $millimeters^2$ but form a total area greater than several square inches.

In some embodiments, the holder provides a mechanical support system for the membrane, for example, via providing clamping points physically contacting the membrane. Accordingly, holders of the invention may comprise one or more clamps that contact selected regions of the membrane, such as the edges of the membrane. Holders of the invention also include a frame connected to the membrane at the one or more contact points, for example, via a fastener, clamp, binder, connector or other similar structure. The holder may have a composition and/or connector configuration providing a selected state of strain of the membrane, for example, useful to achieve an electromechanical biasing useful in the present invention. In an embodiment, the holder is made of a piezoelectric material, such as a piezoelectrical frame (e.g., made from quartz), which allows an in-situ tuning of the mechanical biasing of the membrane. In an embodiment, for example, the strain at the clamping points provided by the holder can also be affected by the non-uniform temperature gradient. In an embodiment, for example, the holder comprises one or more clamps contacting said membrane at the one or more contact points. In an embodiment, the clamps contacting the membrane establish a selected state of strain of the membrane, for example, a state of strain useful for electromechanical biasing. In an embodiment, for example, the holder and the extraction electrode establish a selected electromechanical bias of the membrane.

In an aspect, the membrane is in an overdamped oscillator that is excited by the non-uniform temperature distribution. Use of an overdamped membrane is beneficial for some applications, as it can be used to generate a temporal profile of electron emission characterized by a single peak, thereby increasing the recovery time of the detector and detection method. This aspect of the invention is important for providing detectors and detection methods that have reduced or minimal deadtime between measurements, wherein measurements cannot be made. In an embodiment, for example, the holder comprises one or more clamps contacting said membrane at the one or more contact points that are configured to provide the membrane in the overdamped state. In an embodiment, for example, the holder comprises a material at the one or more contact points (e.g., clamps of a selected material) that provides the membrane in the overdamped state. In an embodiment, for example, the membrane in the overdamped state is excited by the non-uniform temperature distribution and undergoes deformation and relaxation to an original state without additional deformation or vibration of the membrane.

In one embodiment, the emitting layer and internal surface of the membrane are substantially flat without any protrusions. In some embodiments, for example, the membrane has a substantially planar internal surface, wherein the substantially planar surface is characterized by deviations from an absolutely planar surface less than or equal 100 nm. However, using sputtering techniques to add an emitting layer, such as a metal layer, to the internal surface of the membrane may result in small spikes or areas of surface roughness being formed on the emitting layer as compared to a very smooth surface. These spikes and surface roughness may reduce the voltage threshold due to geometrical reduction factor and may enhance the emission probability. In one embodiment, the emitting layer or internal surface has a uniform thickness that does not vary by more than 20% over an active area, preferably for some applications by no more than 10%, preferably for some applications for some applications by no more than 5%. In a further embodiment, the combined thickness of the membrane and emitting layer has a uniform thickness that does not vary by more than 20% over an active area, preferably by no more than 10%, preferably for some applications by no more than 5%.

Alternatively, the invention includes methods and systems wherein the membrane comprises a plurality of nanostructures provided on the internal surface, optionally at least partially covered by the emitting layer. In an embodiment, for example, the internal surface of the membrane is a rough surface having a plurality of nanostructures having aspect ratios selected over the range of 0.1 to 1000. In an embodiment, for example, the internal surface of the membrane has a plurality of nanopillars, optionally having lengths selected over the range of 1 nm to 1000 nm and cross sectional dimensions selected over the range of 1 nm to 1000 nm. In one embodiment of this aspect of the invention, a plurality of resonators are mechanically coupled to the inner surface of the membrane or provided as a component of the membrane structure itself, wherein the resonators comprise an array of pillar resonators, such as nanopillar and/or micropillar resonators, having vertical lengths extending from said inner surface of the membrane along axes that intersect the inner surface. Vibration of the membrane causes the pillar resonators to vibrate laterally with respect to their vertical lengths such that the ends of the pillar resonators positioned distal to the inner surface of the membrane move along substantially accurate, circular, or ellipsoidal trajectories. Detectors and sensors of the present invention having resonators comprising arrays of nanopillar and/or micropillar resonators are beneficial for some applications because they are capable of undergoing substantially periodic oscillations characterized by well-defined and reproducible mechanical mode structure upon vibration of the membrane. In one embodiment, for example, vibration of the membrane causes the pillar resonators to vibrate with reproducible fundamental lateral vibrational modes having resonant frequencies accurately selected over the range of about 1 MHz to about 100 GHz. Maintaining the resonators at a constant pressure, and preferably for some sensing applications at relative low pressures (e.g. less than about 10-100 Torr), is beneficial for providing a reproducible mechanical mode structure and resonance frequencies useful for sensitive and high resolution detection and sensing applications.

Membranes useful for some applications are not permeable with respect to gases and/or liquids and therefore, are capable of maintaining their inner surface at a relative low pressure (e.g. less than 10-100 Torr) while their receiving surface is in contact with a high pressure region, liquid phase or solution phase. In some embodiments, the membrane is provided at a temperature selected over the range of 2 K to 1000 K. Use of a membrane at temperature of 298 K and below may be beneficial for enhancing detection efficiency by reducing sources of noise, such as noise generated by thermal fluctuations.

Optionally, the detector may further comprise a means of releasing the molecule(s) from the receiving surface of the membrane after detection and/or analysis. For example, the present invention includes means of generating a pulse of thermal energy, pulse of electromagnetic radiation, and/or pulse of electric current on the receiving surface of the membrane that is capable of releasing the molecule from the receiving surface.

The electron emitting layer may comprise any material able to emit electrons, for example, via a field emission (FE) process. In one embodiment, the electron emitting layer comprises a material selected from the group consisting of metals, highly doped semiconductors and doped diamond materials. Highly doped diamond materials can be made from diamond-on-insulator (DOI) materials as known in the art. If the electron emitting layer is a thin metallic layer, it is preferable for some applications to use a metal that will not oxidize such as gold. In an embodiment, the emitting layer is provided as a thin film that conformally coats at least a portion of the internal surface of the membrane, preferably between 50% and 100% of the internal surface of the membrane. In an embodiment, the emitting layer has a thickness of 5 nanometers to 25 nanometers. In an embodiment, the electron emitting layer is a metallic layer or doped semiconductor layer that conformally coats at least a portion of the internal surface of the membrane. In an embodiment, the electron emitting layer comprises a material selected from the group consisting of a metal, Al, doped diamond, Si, Ge, $Si_3N_4$, diamond, III/V-semiconductors, Al, Ga, In, As, II/V semiconductors and any combinations thereof.

The extraction electrode may be electrically biased so as to generate field emission, secondary emission, or both, from the internal surface of the membrane or the electron emitting layer provided thereon. In an embodiment, for example, the extraction electrode is a grid electrode or ring electrode positioned between the internal surface of the membrane and the electron detector. In an embodiment, the extraction electrode is one or more grid electrodes or ring electrodes which are at least partially transmissive to incident electrons from the membrane or electron emitting layer. In some embodiments, for example, the extraction electrode is able to transmit at least 50% of the incident electrons and optionally for some applications at least 70% of the incident electrons. Preferably, the electrode is electrically biased by applying a voltage, for example, a voltage equal to of −3000 V to 3000 V. The membrane, and optionally the electron emitting layer, is electrically biased so as to generate field emission, for example, by applying a voltage selected over the range of −3000 V to 3000 V to the internal surface or emitting layer via the extraction electrode. In an embodiment, for example, the extraction electrode establishes an applied electric field on the internal surface of the membrane or electron emitting layer thereon selected from the range of 0 V to 3000 V, optionally 100V to 3000V and optionally 1000V to 3000V, relative to the potential of the membrane. In an alternative embodiment, the membrane is provided substantially at ground and the emitting layer is electronically biased to generate field emission.

The voltage between the membrane and the extraction gate electrode is a parameter that can be varied for a specific application. The higher voltage between the membrane and the extraction gate has two important consequences. First, it causes larger static displacement of the membrane towards the extraction gate, resulting in a higher level of DC field emission current. Second, it increases the stretching force per unit length along the membrane boundary which is one of the factors that determine the characteristic frequency of the nanomembrane. This results in a higher characteristic mechanical frequency of the membrane. In an embodiment, the membrane detector reveals several more ion packets than the chevron MCP at the same laser power.

A range of electron detectors are useful for detecting the emission of electrons from the membrane or emitting layer. The electron detector is positioned such that it receives and detects emission from the membrane and/or emitting layer. Useful electron detectors for sensors of the present invention capable of measuring electric charge, include detectors capable of measuring the intensity of emission from the membrane or emitting layer, such as MCP analyzers, thin film displays and phosphorescent screens. Exemplary electron detectors for detecting emission from the membrane or emitting layer include, charge coupled devices, photodiode arrays, and photomultiplier tubes and arrays thereof. In an embodiment, the electron detector comprises one or more microchannel plates or a dynode.

In an embodiment, the detector further comprises a mass analyzer positioned upstream of the membrane to provide the analytes to the receiving surface, for example, a mass analyzer is selected from the group consisting of a time of flight mass analyzer in linear mode, a time of flight mass analyzer in reflection mode, a quadrupole ion trap, an orbitrap, one or more transmission quadroples, a magnetic sector mass analyzer and a ion trap mass analyzer.

The sensors, detectors and analyzers of the present invention are broadly applicable to a variety of applications. Exemplary applications of the methods, devices and device components of the present invention include, environmental sensing, high-throughput screening, competitive binding assay methods, proteomics, mass spectrometry, quality control, sensing in microfluidic and nanofluidic applications such as lab on a chip sensors, and sequencing DNA and proteins.

In one embodiment, devices of the present invention provide detectors, mass analyzers and charge analyzers for mass spectrometry systems including, but not limited to, ion traps, time-of-flight mass spectrometers, tandem mass spectrometers, and quadrupole mass spectrometers. In one useful embodiment, a sensor of the present invention comprises a detector in a time-of-flight mass analyzer. In an embodiment of this aspect of the present invention, the detector/analyzer is provided at the end of a TOF flight tube and position to receive ions separated on the basis of mass-to-charge ratio exiting the flight tube. Importantly, some analyzers of the present invention provide a means of independently measuring molecular mass and electric charge, in contrast to conventional mass spectrometry systems which typically only provide measurements of mass-to-charge ratio. The fast temporal resolution and large active areas of some of the present sensors and analyzers make them particularly well suited for mass spectrometry applications.

Optionally, the detector is part of a mass spectrometer or a differential mobility analyzer system. For example, in one embodiment the detector is mounted in a MALDI/TOF-system or ESI/TOF-system for mass spectroscopy analysis and, optionally utilizes a multi-channel plate (MCP) for signal amplification. Analytes comprising ions are generated and accelerated in a beam line (TOF setup), which subsequently hit the receiving surface of the membrane. The kinetic energy of the molecule is transferred to the membrane, thereby generating a non-uniform temperature distribution, such as a thermal gradient, that induces emission of electrons from the membrane or emitting layer. The emitted electrons are detected or amplified using an MCP which provides a signal for mass-to-charge ratio analysis and subsequent sample identification.

Methods and systems of the present invention are capable of detecting and/or analyzing a diverse range of molecules, including neutral molecules and molecules possessing electric charge, such as singly and multiply charged ions. In particular, the present methods and systems are useful for detecting an analyzing analytes comprising ions derived from samples containing biomolecules, including, but not limited to biological molecules such as proteins, peptides, DNA molecules, RNA molecules, oligonucleotides, lipids, carbohydrates, polysaccharides, glycoproteins, virus capsid and derivatives, analogs, variants and complexes these including labeled analogs of biomolecules.

In an aspect, the invention provides a method of detecting ions, the method comprising: a) providing a detector comprising: a membrane having a receiving surface for receiving the ions, and an internal surface positioned opposite to the receiving surface, wherein the membrane is a material selected from the group consisting of a semiconductor, a metal and a dielectric, and wherein the membrane has a thickness selected from the range of 5 nanometers to 50 microns; a holder for holding the membrane, wherein said holder contacts said membrane at one or more contact points; an extraction electrode positioned so as to establish an applied electric field on the internal surface of the membrane or an electron emitting layer provided on the internal surface of the membrane, thereby causing emission of electrons from the internal surface or the electron emitting layer; and an electron detector positioned to detect at least a portion of the electrons emitted from the internal surface or the electron emitting layer; b) passing the ions through a mass analyzer to achieve physical separation on the basis of mass-to-charge ratio; c) generating a non-uniform temperature distribution along a thickness dimension, lateral dimension, vertical dimension or any combination of these of the membrane by contacting the receiving surface with the ions after the step of passing the ions through said mass analyzer, thereby exciting a mechanical deformation of the membrane that modulates the emission of electrons from the internal surface of the membrane or the emitting layer; d) detecting the electrons emitted from the internal surface of the membrane or the emitting layer; e) measuring intensities of the electrons emitted from the internal surface of the membrane or the emitting layer as a function of time, thereby generating a response signal characterized by one or more peaks at different times, wherein each peak is characterized by a maximum value; f) identifying a first peak corresponding to an earliest time; and g) determining the maximum value corresponding to the first peak. In an embodiment of this aspect, the present method further comprises determining a detection time corresponding to the maximum value, wherein the detection time is proportional to a flight time of the ions. In an embodiment, the response signal is characterized by a series of peaks. In an embodiment of this aspect, the ions are derived from biomolecules, such as one or more peptides, proteins, oligonucleotides, polysaccharides, lipids, carbohydrates, DNA molecules, RNA molecules, glycoproteins, lipoproteins or virus capsides. In an embodiment, the ions are derived from a sample containing one or more proteins, for example, a mixture of peptides obtained via digestion of a protein containing sample. In an embodiment, for example, ions are derived from a sample containing analyte peptides that are subject to separation, e.g., via electrophoresis, prior to generation and analysis of ions. In an embodiment, for example, the one or more peaks corresponds to a series of peaks corresponding to packets of ions having different flight times.

Without wishing to be bound by any particular theory, there can be discussion herein of beliefs or understandings of underlying principles or mechanisms relating to the invention. It is recognized that regardless of the ultimate correctness of any explanation or hypothesis, an embodiment of the invention can nonetheless be operative and useful.

DETAILED DESCRIPTION OF THE INVENTION

Figure 1:
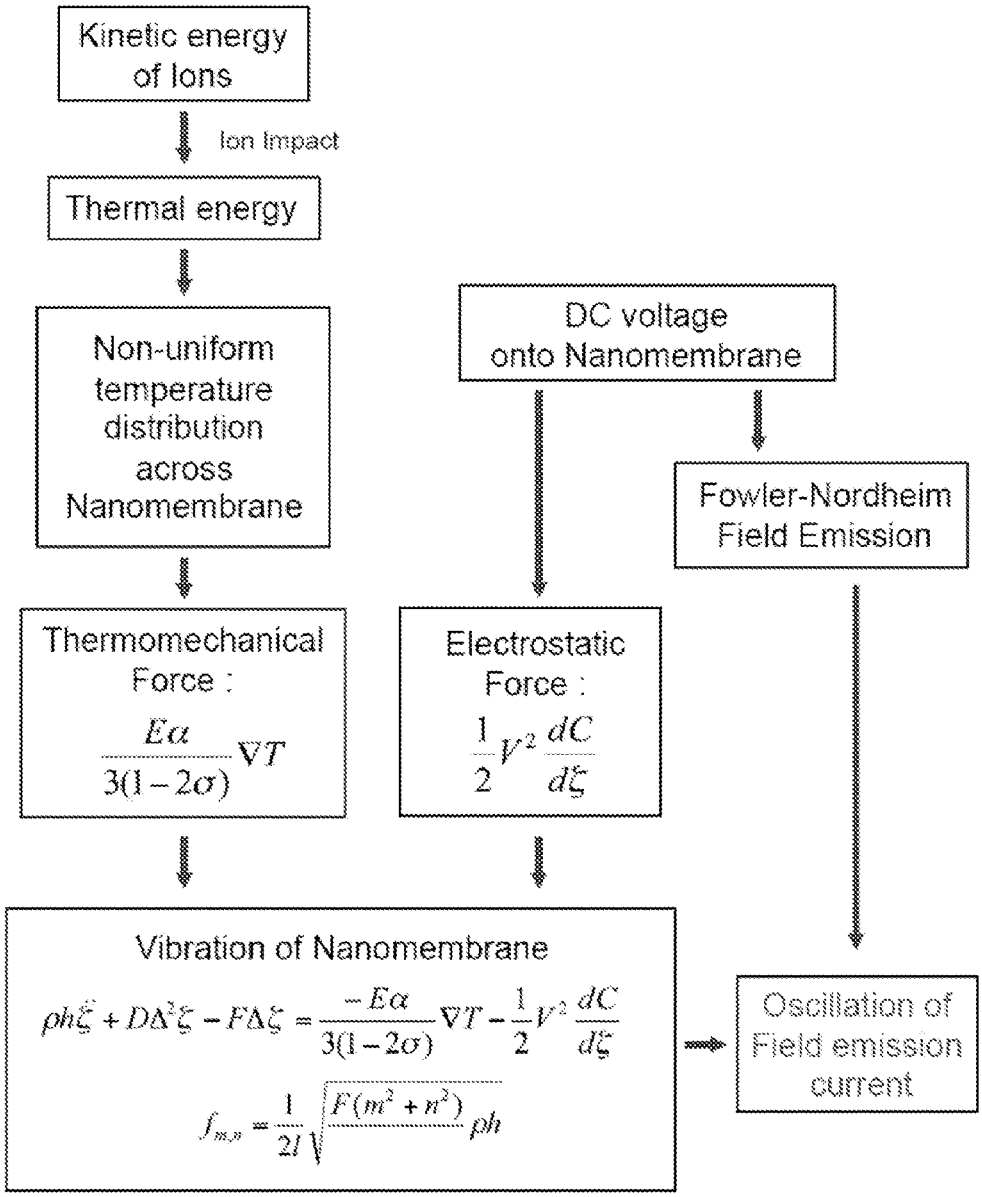
FIG. 1. A flow diagram illustrating an example of a method for detecting analytes, such as ions derived from biomolecules, using a nano-membrane-based detector of the present invention.

Referring to the drawings, like numerals indicate like elements and the same number appearing in more than one drawing refers to the same element. In addition, hereinafter, the following definitions apply:

"Molecule" refers to a collection of chemically bound atoms with a characteristic composition. As used herein, a molecule refers to neutral molecules or electrically charged molecules (i.e., ions). Molecules may refer to singly charged molecules and multiply charged molecules. The term molecule includes biomolecules, which are molecules that are produced by an organism or are important to a living organism, including, but not limited to, proteins, peptides, lipids, DNA molecules, RNA molecules, oligonucleotides, carbohydrates, polysaccharides; glycoproteins, lipoproteins, sugars and derivatives, variants and complexes of these. Analytes of the present invention may be one or more molecules.

"Ion" refers generally to multiply or singly charged atoms, molecules, and macromolecules having either positive or negative electric charge and to complexes, aggregates and clusters of atoms, molecules and macromolecules having either positive or negative electric charge. Ion includes cations and anions. Analytes of the present invention may be one or more molecules.

"Membrane" refers to a device component, such as a thin, optionally flat or planar structural element. Membranes of the present invention include semiconductor, metal and dielectric membranes able to emit electrons when molecules contact the receiving side of the membrane. Membranes useful in the present invention may comprise a wide range of additional materials including dielectric materials, ceramics, polymeric materials, glasses and metals.

"Field emission" (FE) or "field electron emission" (FEE) is the discharge of electrons from the surface of a condensed material (such as a metal or semiconductor) subjected to a electric field into vacuum, low pressure region or into another material.

"Secondary emission" or "secondary electron emission" (SEE) is a phenomenon where primary incident particles of sufficient energy, when hitting a surface or passing through some material, induce the emission of secondary particles, such as electrons.

"Active area" refers to an area of a detector of the present invention that is capable of receiving molecules and generating a response signal, such as a response signal comprising emitted electrons.

"Phonon" refers to a unit of vibrational energy that arises from oscillating atoms within a crystal lattice.

"Semiconductor" refers to any material that is a material that is an insulator at a very low temperature, but which has an appreciable electrical conductivity at a temperature of about 300 Kelvin. In the present description, use of the term semiconductor is intended to be consistent with use of this term in the art of microelectronics and electrical devices. Semiconductors useful in the present invention may comprise element semiconductors, such as silicon, germanium and doped diamond, and compound semiconductors, such as group IV compound semiconductors such as SiC and SiGe, group III-V semiconductors such as AlSb, AlAs, Aln, AlP, BN, GaSb, GaAs, GaN, GaP, InSb, InAs, InN, and InP, group III-V ternary semiconductors alloys such as AlxGa1-xAs, group II-VI semiconductors such as CsSe, CdS, CdTe, ZnO, ZnSe, ZnS, and ZnTe, group I-VII semiconductors CuCI, group IV-VI semiconductors such as PbS, PbTe and SnS, layer semiconductors such as $PbI_2$, MoS2 and GaSe, oxide semiconductors such as CuO and $Cu_2O$. The term semiconductor includes intrinsic semiconductors and extrinsic semiconductors that are doped with one or more selected materials, including semiconductor having p-type doping materials and n-type doping materials, to provide beneficial electrical properties useful for a given application or device. The term semiconductor includes composite materials comprising a mixture of semiconductors and/or dopants.

In the following description, numerous specific details of the devices, device components and methods of the present invention are set forth in order to provide a thorough explanation of the precise nature of the invention. It will be apparent, however, to those of skill in the art that the invention can be practiced without these specific details.

FIG. 1 provides a flow diagram illustrating an example of a method for detecting analytes, such as ions derived from biomolecules, using a nano-membrane detector of the present invention. As shown in FIG. 1, provided is a detector of the invention having a nano-membrane that is electromechanically biased, for example, using a combination of a holder for holding the membrane at one or more contact points and an extraction electrode positioned to provide a selected electric field on the internal surface of the nano-membrane or an emitting layer provided thereon. In some embodiments, the electrical biasing provided by the extraction electrode is sufficient to generate an electrostatic force providing for continuous Fowler-Nordheim field emission from the nanomembrane or emitting layer provided on the nanomembrane. The field emission from the nano-membrane or emitting layer is detected via an electron detector position to receive the field emission. Optionally, the detected field emission is characterized as a field emission current as function of time.

As also shown in FIG. 1A, ions having a characteristic average kinetic energy are directed at the detector so as to impact the receiving surface of the membrane or layer provide thereon. Contact with the receiving surface converts at least portion of the kinetic energy of the ions in thermal energy, thereby generating a non-uniform temperature distribution across and/or within at least a portion of the nanomembrane. The non-uniform temperature distribution generates a thermomechanical force(s) that excites one or more vibrations in the nanomembrane. The resulting vibrations modulate the distance between the nanomembrane and the extraction electrode, thereby achieving an oscillation of the observed field emission current. Accordingly, monitoring changes in the field emission current provides a means of detecting and characterizing the analytes interacting with the receiving surface of the nano-membrane detector.

In some embodiments, in the absence of the analyte, the nanomembrane is stationary, but it emits electrons from its internal surface by field emission and, optionally, is deformed toward the extraction gate due to the applied electric field. When the analytes, such as ions having a preselected average kinetic energy, contact the receiving surface of the membrane or an absorber layer provided thereon, the kinetic energy of the analytes is transferred mostly into thermal energy. This raises the temperature in the vicinity of the impact site causing a non-uniform temperature distribution across, or within, at least a portion the nanomembrane. This thermal gradient leads to thermomechnical forces, resulting in mechanical deformation and vibration of the nanomembrane. Since the intensity of field emission is strongly dependent on the electric field, which in turn is determined by the distance between the nanomembrane and the extraction gate electrode, mechanical vibrations of the nanomembrane translate into corresponding oscillations in the field emission current.

The intensities of the field emission in some embodiments does not highly depend upon the m/z of the impinging ions. It rather depends on the shape of ion packet, which translates into a corresponding thermal gradient. The steeper the slope of the leading edge of the ion packet, the higher thermal gradient and the force induced. The shape of ion packet is mainly determined by mass broadening caused by the isotope distribution and instrument resolution. Mass broadening caused by the isotope distribution of BSA and IgG are 30 and 46 Da (10%-valley criteria), respectively. This leads to a broadening in the time-of-flight of 49.8 ns and 50.8 ns, respectively. A broader ion packet at higher masses translates into a lower slope of the leading edge of the ion packet, which results in a lower force induced by ion bombardment.

In time of flight (TOF) mass spectrometry applications of the present methods, ions are first accelerated in an electric field, and directed into a field-free drift tube where they separate by mass-to charge ratio (m/z) before impinging on the nano-membrane detector. In some embodiments, the time when the ions are impinging on the membrane is measured, corresponding to the time of modulated field emission current induced. Based on these time of flight of ions, the mass of the ions is determined. Absolute mass determination may be provided by the mass analyzer, time-of-flight (TOF) analyzer.

In an embodiment, the membrane is an overdamped oscillator, such as an overdamped harmonic oscillator. Mechanical overdamping is achieved in some embodiments by integration of the membrane and the holder component of the detector. In some embodiments, for example, the holder includes one or more clamps provided at contact points on the membrane, wherein upon excitation of the membrane the clamps provide a means of removing energy, thereby providing damping the membrane. Overdamped membranes of some embodiments are able to mechanically deform upon impact of an ion packet with the receiving surface and undergo relaxation to the original state without undergoing subsequent mechanical deformation or vibration as a result of the initial impact of the ion packet. In this manner, the deformation of the overdamped membrane results in a detectable modulation of the electron emission followed by a return of the detector to a state ready for another measurement. Use of overdamped membranes in the present methods and systems is useful to minimize "dead time" of the detector in which the detector is ringing down from an earlier detection event. In this manner, detectors of the invention allowing independent detector conditions for measurements closely spaced in time.

In some embodiments, the vibration modes of the nanomembrane, $\zeta_{m,n}(t)$, can be described by harmonic oscillators with the characteristic frequencies $\omega_{m,n}$, damping factor $k_{m,n}$, and external force f(t):

$$\ddot{\zeta}_{m,n} + 2k_{m,n}\omega_{m,n}\dot{\zeta}_{m,n} + \omega_{m,n}^2\zeta = f(t), \tag{1}$$

where the characteristic frequencies, $f_{m,n}$ are:

$$f_{m,n} = \frac{1}{2l}\sqrt{\frac{T(m^2+n^2)}{\rho h}}, \tag{2}$$

where T is tension per unit length, ρ is density, h is thickness, and m and n are integer values. The five different mode frequencies obtained from the FFT spectrum are: $f_{1,1}$=1.825 MHz, $f_{2,2}$=3.65 MHz, $f_{4,4}$=7.52 MHz, $f_{5,5}$=8.94, and $f_{7,7}$=12.05 MHz.

We consider the force induced by ion bombardments with normalized Gaussian function, which can be expressed by:

$$f(t) = \frac{1}{\sigma\sqrt{2\pi}}\exp\left(-\frac{(t-\mu)^2}{2\sigma^2}\right), \tag{3}$$

where σ is the standard deviation, μ is the mean.

Solving equation (1) with three dominant mode frequencies, $\omega_{1,1}$*, $\omega_{4,4}$, and $\omega_{7,7}$, separately using Matlab Simulink yields results for $\zeta_{1,1}$*(t), $\zeta_{4,4}$(t), and $\zeta_{7,7}$(t). (* indicates overdamped oscillations). Mixing of these three modes yields not only superposition of modes but also superposition of the product of each mode with different weights. Therefore, ζ(t) can be given by:

$$\zeta(t)=a\zeta_{1,1}^*(t)+b\zeta_{4,4}(t)+c\zeta_{1,1}^*(t)\zeta_{4,4}(t)+d\zeta_{7,7}(t)+ e\zeta_{1,1}^*(t)\zeta_{7,7}(t)+f\zeta_{4,4}(t)\zeta_{7,7}(t)+g \tag{4}$$

where a, b, c, d, e and f are numerical constants and g is the DC component.

Figure 2:
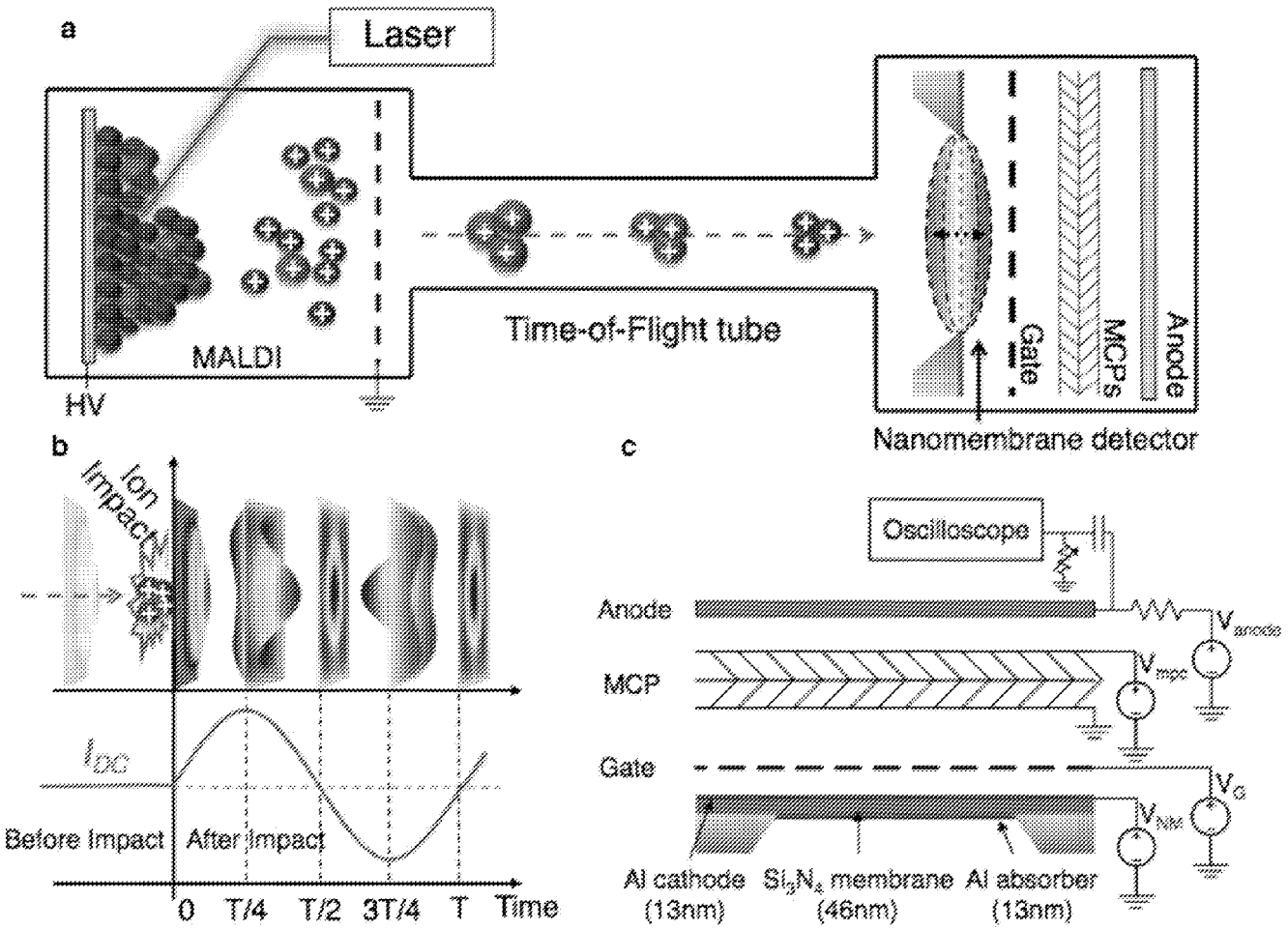
FIG. 2. Operating a nanomembrane protein detector: a, Schematic of the detector coupled to a MALDI-TOF mass spectrometer. Proteins are desorbed, ionized, and accelerated by a large DC extraction voltage into the time-of-flight tube. b, Detailed illustration of the operation principle of the detector. Ion bombardment excites the mechanical vibration of the nanomembrane, resulting in a modulation of the field emission current. c, Schematic of the detector configuration, consisting of a tri-layer made of $Al/Si_3N_4/Al$, an extraction gate, MCP, and an anode. The oscilloscope allows real-time detection of the nanomembrane's mechanical oscillation.

It should be noted that $f_{7,7}$(t) and $\zeta_{1,1}$*(t)$\zeta_{7,7}$(t) as well as $\zeta_{4,4}$(t) and $\zeta_{1,1}$*(t)$\zeta_{4,4}$(t) cannot be distinguished due to the phase noise and low value of $f_{1,1}$*. FIG. 2 shows the calculated ζ(t) (blue line) and the overdamped fundamental mode (red dots) $\zeta_{1,1}$*(t).

Figure 8:
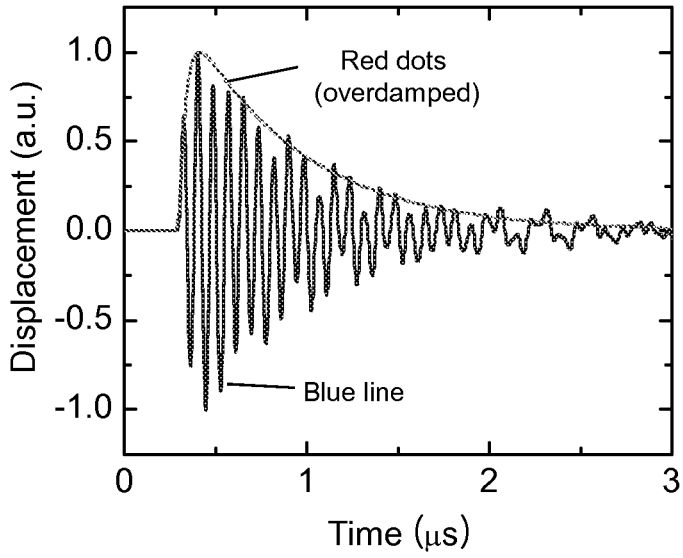
FIG. 8. Calculated dynamic displacement of the nanomembrane (blue line) in addition to the overdamped fundamental mode (red dots).

A main feature of the overdamped fundamental mode is that the system returns to equilibrium exponentially without subsequent oscillation. For example, FIG. 8 shows a plot of calculated dynamic displacement of the membrane as a function of time wherein the overdamped membrane is shown as red dots (see, also "overdamped" label in FIG. 8) and the non-overdamped system is shown as the blue lines.

Figure 9:
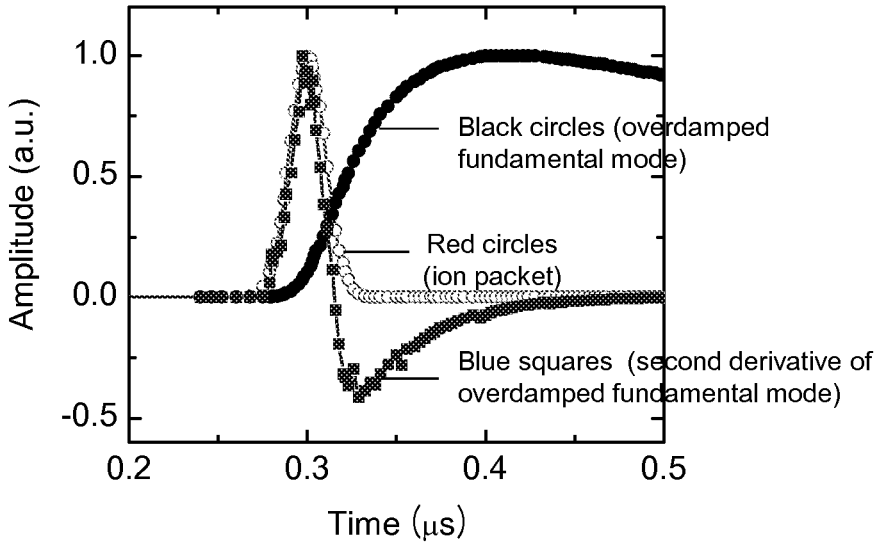
FIG. 9. Illustration of the determination of the time of flight. Red and black circles represents the ion packet and overdamped fundamental mode, respectively. Blue square represents the second derivative of the overdamped fundamental mode, which reveals the maximum intensity of the ion packet.

FIG. 9 illustrates an example of a method of the invention for the determination of the time-of-flight of the detected ion packet. Red circles and black circles represents the ion packet and overdamped fundamental mode, respectively (see, figure labels). The blue square represents the second derivative of the overdamped fundamental mode (see, figure label). As shown in FIG. 9, the overdamped fundamental mode is excited when the leading edge of the ion packet arrives at the nanomembrane (see time scale of red and black circles). In addition to the time-of-flight of the leading edge of the ion packet, the second derivative of the overdamped fundamental mode reveals the time of flight of maximum intensity of the ion packet (see time scale of red circles and blue squares).

The invention is further detailed in the following Examples, which are offered by way of illustration and are not intended to limit the scope of the invention in any manner.

EXAMPLE 1

A Mechanical Nanomembrane Detector for Time-of-Flight Mass Spectrometry

Abstract

A mass spectrometer is a system comprised of three major parts: an ionization source, which converts molecules to ions; a mass analyzer, which separates ions by their mass to charge ratio; and an ion detector. Mass spectrometry was revolutionized in the late 1980s by the invention of electrospray ionization (ESI)[1] and matrix-assisted laser desorption/ionization (MALDI)[2,3], which jointly provided means of generating ions from previously inaccessible large molecules such as proteins and peptides. Mass analyzer designs have since evolved to accommodate the large ions that are produced, providing dramatic improvements in performance. However, little has changed in the area of ion detection, where ions continue to be detected by one of three basic principles[4]: direct charge detection (as in the Faraday cup detector), image charge detection (as in the inductive detector), or secondary electron generation (as in the electron multiplier (EM) or microchannel plate (MCP) detector). We describe here a new principle for ion detection in time-of-flight (TOF)[5] mass spectrometry, in which an impinging ion packet excites mechanical vibrations in a silicon nitride ($Si_3N_4$) nanomembrane. The nanomembrane oscillations are detected by means of time-varying field emission of electrons from the mechanically oscillating nanomembrane. Ion detection is demonstrated in the MALDI-TOF analysis of proteins varying in mass from 5,729 (insulin) to 150,000 (Immunoglobulin G) daltons. The detector response agrees well with the predictions of a thermomechanical model in which the impinging ion packet causes a non-uniform temperature distribution in the nanomembrane, exciting both fundamental and higher order oscillations.

Introduction

In TOF mass spectrometry, ions are accelerated in an electric field, and directed into a field-free drift tube where they separate by mass-to charge ratio (m/z) before impinging upon a detector. TOF mass spectrometry is particularly important for the mass analysis of large ions in low charge states, such as those produced in the matrix-assisted laser desorption/ionization (MALDI) process as it is the only mass analyzer design known with an essentially unlimited m/z range. The ideal TOF detector would have a large area, as the ion packets can have considerable spatial extent by the time they reach the end of the drift tube; it would be fast, in order to provide the necessary timing resolution between successive ion packets; and it would be sensitive, so that as few ions as possible could be detected. The detectors that have best met these requirements to date are the electron multipliers (EM) or microchannel plate (MCP) detectors. In these detectors the incident ions generate secondary electrons, which are then amplified in a sequential cascade process to yield a magnified output signal. The detectors have large active areas and rapid response times, thereby meeting two of the three essential criteria; in addition, for smaller, fast-moving ions, the conversion efficiency of incident ions to secondary electrons is quite high, making the detectors highly sensitive[6-8]. Thus, for the time-of-flight analysis of relatively low m/z ions (e.g. <~1000 daltons), existing detectors are highly effective.

However, it has been known for many decades that these detectors suffer from a severe shortcoming for the analysis of large m/z ions such as the singly charged proteins produced in the MALDI process. The secondary electron generation efficiency, $\gamma_e$, decreases as $v^{4.4}$ where v is the velocity of the incident ion[6]. Since in TOF, the heavier the ion, the more slowly it moves down the flight tube, this leads to a marked decrease in ion detection efficiency for larger ions[6-11]. This limitation in ion detection is further exacerbated in the analysis of protein mixtures, where detector saturation effects also come into play[6]. These issues in ion detection efficiency are one of the central reasons that modern mass spectrometry remains predominantly restricted to the analysis of lower molecular weight species (e.g. tryptic peptides rather than intact proteins). One interesting approach to addressing this problem, the cryogenic microcalorimeter, was described in the literature about a decade ago[12-16]. These devices, which are operated at a temperature of 4K, exhibit very high detection efficiency approaching 100%, along with low noise levels, enabling both single ion counting capability and the ability to discriminate singly charged from doubly charged ions by providing a measure of the amount of kinetic energy deposited in the detector by the ion impact. However, their utility is compromised by their necessarily small size (e.g. 200 μm×200 μm)[12] and the requirement for a cumbersome and expensive cryogenic cooling system. More recently, several reports have appeared describing nanomechanical resonators whose resonance frequency is perturbed by surface adsorption of an ion[17-24]. Although this approach has demonstrated exceptional mass sensitivity, the devices suffer as well from extremely low active areas and slow response times and are thus far from being suitable for practical use in TOF mass spectrometry at present.

We describe in this Example a new approach to TOF ion detection, based upon the mechanical deformation and vibration of a nanomembrane. As shown in FIG. 2, the nanomembrane detector consists of four parts, a nanomembrane, an extraction gate, a microchannel plate, and an anode, and in the present work is placed at the end of the flight tube in a commercial MALDI-TOF mass spectrometer (Perseptive Biosystems Voyager-DE STR). The square (5 mm×5 mm) nanomembrane consists of a suspended tri-layer of $Al/Si_3N_4/Al$. The metal layers on top and below the $Si_3N_4$ act as a cathode for electron emission and absorber of incident ions, respectively. The principle of operation of the detector is illustrated graphically in FIG. 2*b*, and is as follows. In the absence of ion bombardment, the nanomembrane is stationary, but it emits electrons from its cathode by field emission[25] and is deformed toward the extraction gate due to the applied electric field (see supplementary information). Since the intensity of field emission is strongly dependent on the electric field, which in turn is determined by the distance between the nanomembrane and the extraction gate electrode, mechanical vibrations of the nanomembrane excited by ion bombardment translate into corresponding oscillations in the field emission current. The modulated field emission current is superimposed on the DC field emission current, which is then amplified by the microchannel plate (MCP) and collected by the anode. A capacitor connected between the anode and oscilloscope provides AC coupling, allowing the time-varying field emission current to pass through but blocking the DC field emission current. Consequently, only the modulated field emission current is recorded by the oscilloscope in real time. The potentiometer connected between the oscilloscope and the ground provides the impedance matching between the oscilloscope and the rest of the detector circuitry, providing better signal responses.

Figure 3:
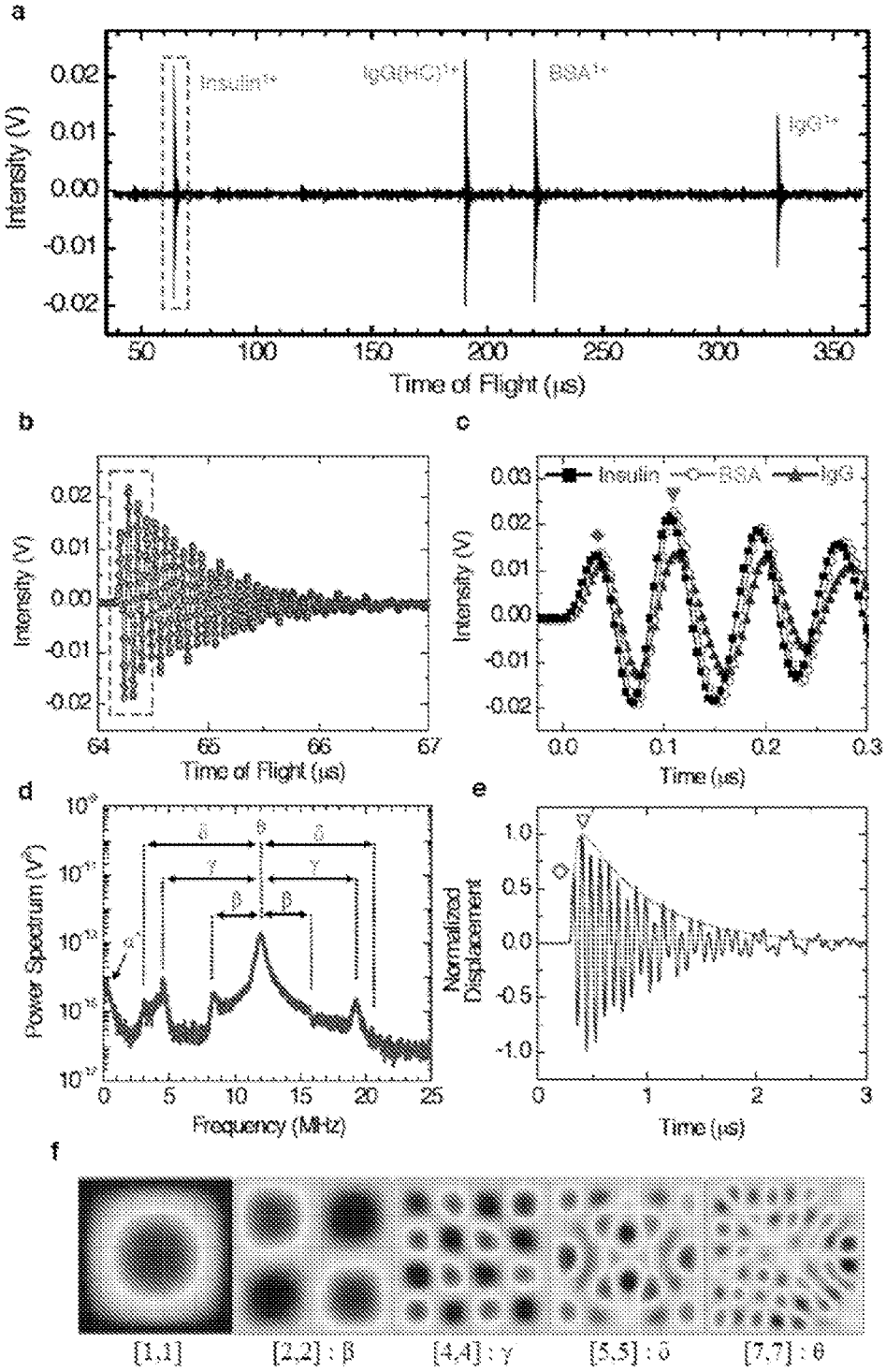
FIG. 3. Nanomembrane detector response: a, Mass spectrum for an equimolar protein mixture of insulin, bovine serum albumin (BSA), and immunoglobulin G (IgG) with a sinapinic acid matrix, showing signal peaks for singly charged Insulin, BSA, and IgG along with a heavy chain of IgG. The time scale is deliberately not converted to the mass range. b, Fine structure of the Insulin peak: the peak reveals an oscillating signal with a characteristic relaxation time. c, Comparison of the signals for Insulin (black box), BSA (red circle), and IgG (blue triangle) on a sub-microsecond scale. The proteins were desorbed and ionized in a single sample made from an equimolar mixture of the three (the time scales for each peak have been offset so that they all start at t=0). Note the almost identical peak heights of the first oscillation peak for all different proteins. d, Modal analysis of the mechanical oscillations of the nanomembrane given as a Fourier transformation plot. The most dominant mode θ is a higher-order mechanical mode. The analysis is based on the measured field emission response. The contribution of the other modes and harmonics is much less pronounced. e, Numerically calculated vibration of the nanomembrane by mixing three modes, overdamped fundamental mode, $f_{4,4}$ (γ), and $f_{7,7}$ (θ) (blue line). The red dashed line indicates the response of the overdamped fundamental mode, which determines the decay of the nanomembrane response. f, Calculated mode shape of vibration FIG. 4. Load-displacement relationship of the nanomembrane under uniform load. a, Maximum (red circles) and averaged (blue squares) displacement of the nanomembrane as a function of pressure. At low pressure, the displacement is proportional to the pressure, however, at high pressure, the displacement is proportional to the cube-root of the pressure. b, Maximum (red circles) and averaged (blue squares) displacement of the nanomembrane as a function of voltage applied between the nanomembrane and the extraction gate, $V_{GM}$. The ratio of averaged and maximum displacement of 0.48 was calculated using the shape function. The maximum displacement of 81.7 μm and the averaged displacement of 39.5 μm were calculated for the operating voltage $V_{GM}$ at 1.25 kV.

FIG. 3*a* shows a MALDI mass spectrum obtained using the nanomembrane detector for an equimolar protein mixture (3.3 μM each) of insulin (5,729 Dalton (Da)), bovine serum albumin (BSA, 66,429 Da), and immunoglobulin G (IgG, ~150,000 Da) in a sinapinic acid matrix. The time-of-flight measured by the detector corresponds roughly to the time-of-flight of the leading edge of the ion packet, as this is what initiates the membrane oscillation.

In addition to the three singly charged insulin, BSA, and IgG peaks, a fourth peak, corresponding to a heavy chain of IgG, is also observed at a time of flight of ~190 μs. In FIG. 3*b*, a magnified view of the insulin peak is given, which clearly shows a mechanical vibration of the nanomembrane with a resonance frequency of ~12.05 MHz. FIG. 3*c* shows a superposition of the signal obtained for each of the three proteins, and illustrates that the first peak height (labeled as ♦) and the frequency of the membrane oscillation, once initiated by the impact of the ion packet, do not depend strongly upon the m/z of the impinging ions. The maximum and minimum amplitudes of the insulin peak are 21.7 mV and −18.7 mV, respectively, which correspond to a maximum of 40 pA and a minimum of 19.8 pA of the field emission current. The corresponding average displacements to yield this level of field emission current were found to be +6.5 μm and −7.7 μm with respect to the average static displacement of 39.5 μm (with voltage and distance between the nanomembrane and the extraction gate set to 1.25 kV and 127 μm, respectively).

The transduction of ion kinetic energy into membrane oscillation is described well by a thermomechanical model[26]. In this model, when accelerated ions propagate through the flight tube and bombard the absorber, the kinetic energy (in MALDI-TOF, typically 25 keV) is transformed mostly into thermal energy. This raises the temperature in the vicinity of the impact site causing a non-uniform temperature distribution across the nanomembrane. This thermal gradient leads to thermomechanical forces, resulting in mechanical deformation and vibrations of the nanomembrane. The deformation and vibrations of the nanomembrane due to the thermal force and the applied DC-voltage onto the nanomembrane can be expressed by[27]

$$\rho h\ddot{\zeta} + D\Delta^2\zeta - F\Delta\zeta = \frac{-E\alpha}{3(1-2\sigma)}\nabla T - \frac{1}{2}V^2\frac{dC}{d\zeta} \quad [1]$$

where ζ is the vertical displacement, ρ is the density, h is thickness of the nanomembrane, $D=Eh^3/12(1-\sigma^2)$ is the flexure rigidity, E is Young's modulus, σ is the Poisson ratio, F is the stretching force per unit length of the edge of the nanomembrane, α is the thermal expansion coefficient, T is the temperature increase above a uniform ambient level, V is the extraction gate voltage, and C is the capacitance between the nanomembrane and the extraction gate. The first and second terms on the right correspond to the forces generated by the thermal gradient and the electrostatic voltage, respectively.

The evolution of the mechanical vibration can be divided into two major time regimes, (i) a transient, and (ii) a relaxation. The transient is initiated by the leading edge of the ion packet, which causes the thermal gradient and thus initiates the membrane excitation. In the subsequent relaxation process, the non-uniform temperature distribution established by the leading edge of the ion packet becomes uniform by thermal conduction while the rest of the ions in the ion packet continue to impinge upon the nanomembrane. These ions do cause additional temperature changes, but the gradient they produce is not steep enough to reinitiate the vibration. Thus, the vibration ceases, the nanomembrane relaxes back to thermal equilibrium, and is ready to sense the arrival of any subsequent ion packets.

A Fourier transformation of the trace in FIG. 3*a*, shown in FIG. 3*d*, reveals the mechanical modes excited by ion bombardment and their contributions to the overall power spectrum. The characteristic frequencies for the vibration of the nanomembrane, $f_{i,j}$, can be expressed by[27]

$$f_{i,j} = \frac{1}{2l}\sqrt{\frac{F(i^2 + j^2)}{\rho h}} \quad [2]$$

where l is the side length of the nanomembrane, i and j are integer values, ρ is the density, h is thickness of the nanomembrane, and F is the stretching force per unit length of the edge of the nanomembrane.

The dominant feature in the power spectrum is the central mode $f_{7,7}$=12.05 MHz (θ), with sidebands on both sides due to its mixing with other frequencies. The three other dominant modal frequencies found from the power spectrum are: $f_{2,2}$=3.65 MHz (β), $f_{4,4}$=7.52 MHz (γ), and $f_{5,5}$=8.94 MHz (δ). These modes are mixed with the most dominant mode, $f_{7,7}$=12.05 MHz (θ), due to the nonlinearity of Fowler-Nordheim field emission[25], yielding multiple sets of two sidebands, $\theta-f_{i,j}$ and $\theta+f_{i,j}$. In addition to the four dominant modes, the fundamental mode with the characteristic frequency, $f_{1,1}$=1.825 MHz, can be derived from equation [2]. The mechanical vibration shape corresponding to each mode is shown in FIG. 3*f*. In the time domain, the mixing of each mode results in modulation of their amplitudes. It should be noted that the fundamental mode, $f_{1,1}$, does not appear at the frequencies of $\theta-f_{1,1}$ and $\theta+f_{1,1}$ in the power spectrum and there is a peak near DC, labeled as α*. This is due to overdamping of the fundamental mode by the applied electrostatic force. The coefficient α* is the sinusoidal decomposition of the overdamped fundamental mode (see supplementary information). A numerical calculation for the mixing of the overdamped fundamental mode $f_{1,1}$ with $f_{4,4}$(γ), and $f_{7,7}$(θ), yields an oscillation profile that closely resembles the experimental data as shown in FIG. 3*e*. The envelope of the most dominant mode, θ, decays exponentially without oscillating due to modulation by the overdamped fundamental mode (red dashed line) (see supplementary information).

Figure 6:
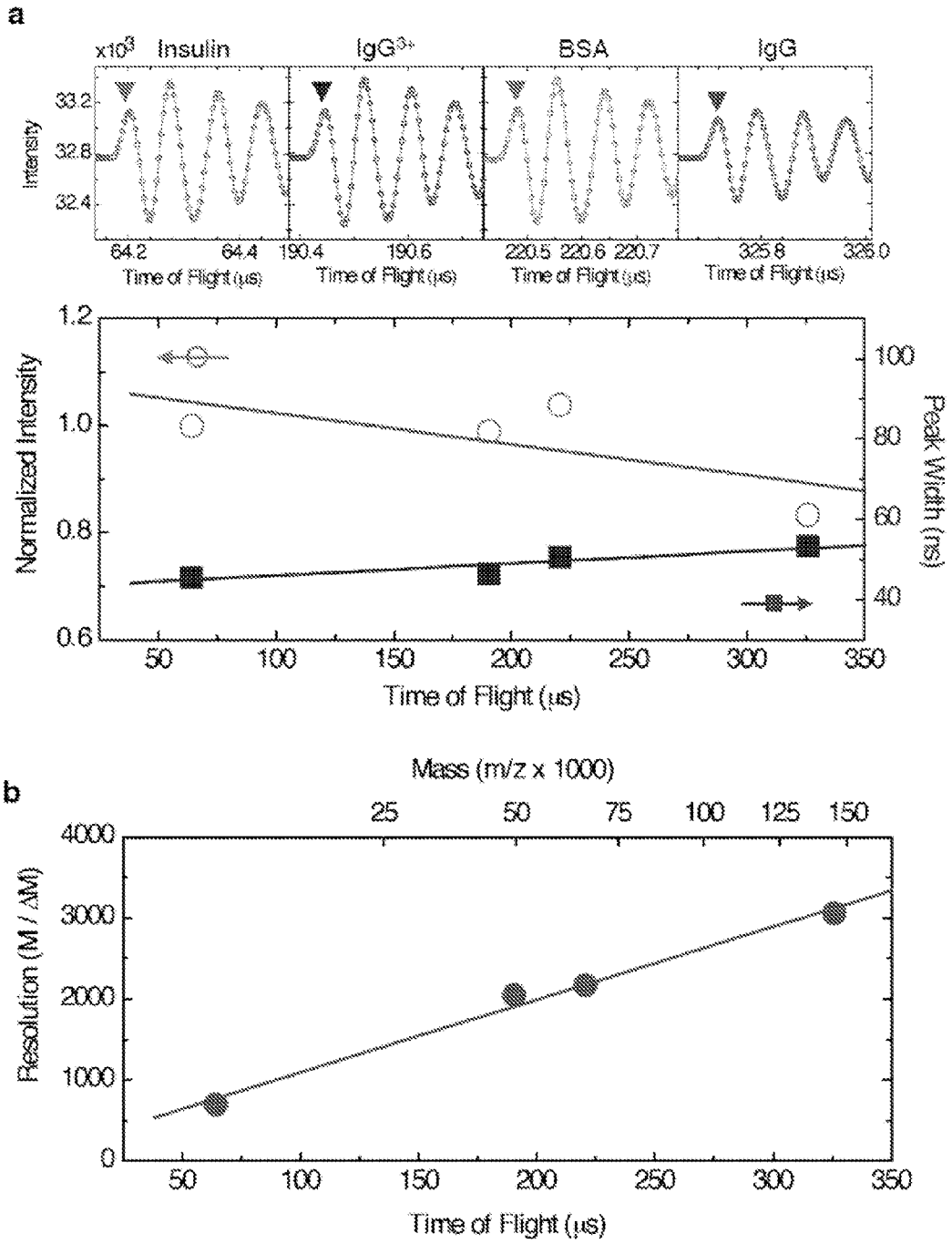
FIG. 6. a. The upper sequence of plots gives the individual traces of the nanomembrane detector response for four different proteins. As seen the first peak of the nanomembrane's response to proteins show almost identical amplitudes. Plotting these first peaks' amplitudes and widths vs. the mass range (proportional to the flight time) indicates that the amplitude is almost constant. This enables operation of the nanomechanical detector independently of the protein mass. The width increases for larger masses mainly due to the broader isotope distribution at higher masses. b, Taking the width of the first resonance peak as the lower limit of the temporal resolution, consequently the mass resolution increases towards higher masses.

FIG. 6*a* in the upper sequence of plots gives the individual traces of the nanomembrane detector response for four different proteins. As seen the first peak of the nanomembrane's response to proteins show almost identical amplitudes. Plotting these first peaks' amplitudes and widths vs. the mass range (proportional to the flight time) indicates that the amplitude is almost constant. This enables operation of the nanomechanical detector independently of the protein mass. The width increases for larger masses mainly due to the broader isotope distribution at higher masses. b, Taking the width of the first resonance peak as the lower limit of the temporal resolution, consequently the mass resolution increases towards higher masses.

The oscillations can be divided into two major time regimes, (i) a transient, and (ii) a relaxation. The transient corresponds to the leading edge of the ion packet, which excites the first peak of the vibration. In the relaxation regime, the temperature distribution becomes uniform, by thermal conduction, and the vibration has ceased. FIG. 6*a* shows height and width of the first peak for each protein, which falls into the transient regime. As seen, the height is reduced only slightly and the width increases slightly at higher masses. This is mainly due to the shape of the ion packets, which is smaller in height but broader in width at higher masses due to the mass broadening caused by isotope distribution. FIG. 6*b* shows a resolution over the mass range. We used the width of the first peak as the time resolution of the detector. With the time resolution being fixed for all masses, the mass resolution (m/Δm) increases with increasing molecule mass.

Figure 7:
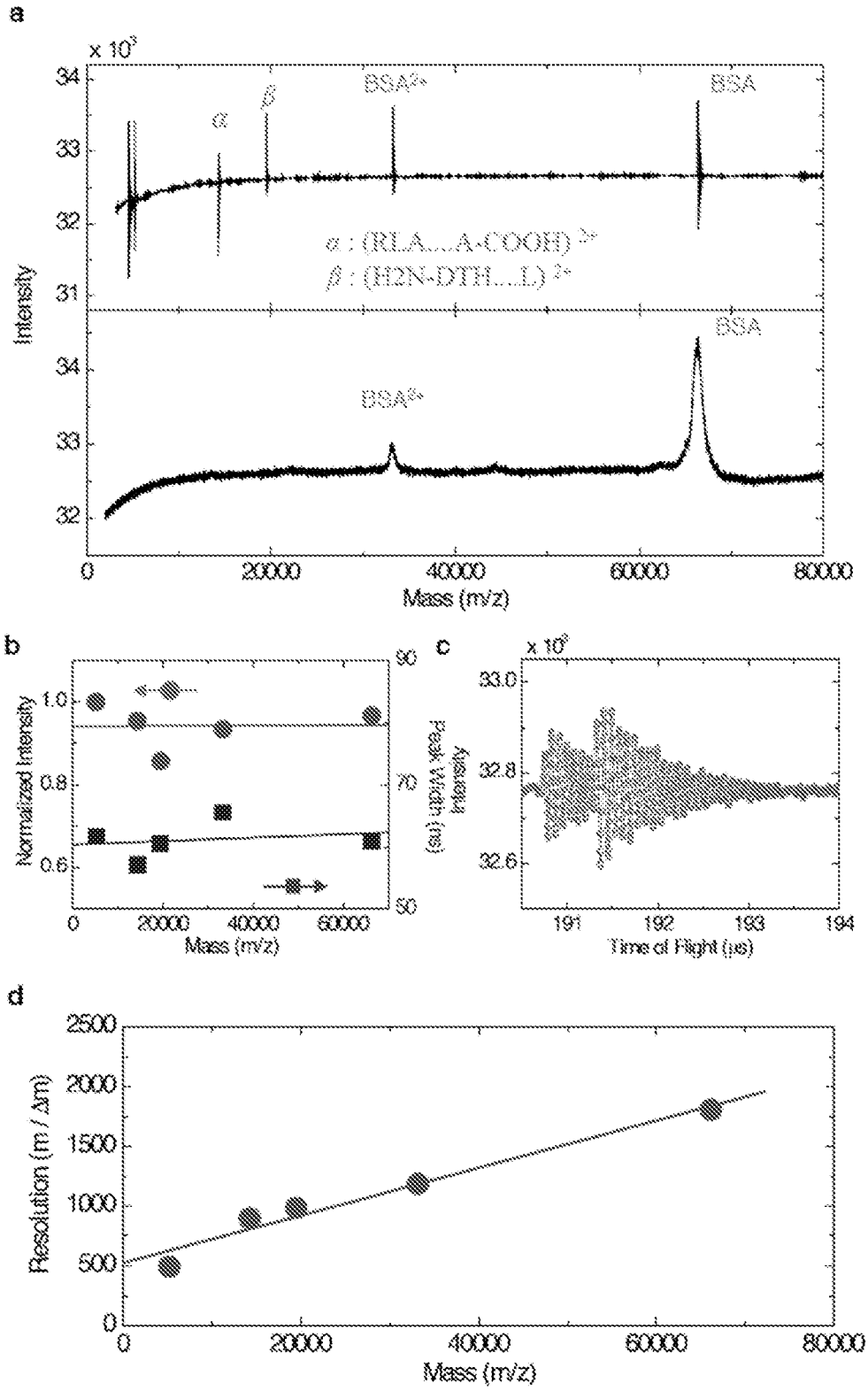
FIG. 7. Comparison of the nanomembrane detector and a commercial multi-channel plate (MCP) detector: a, the nanomembrane's response yields a much higher resolution as compared to the broad peaks of the MCP. Furthermore, the nanomembrane detector 'sees' many more resonances than the MCP with a large amplitude response. b, Plotting the normalized value of the first oscillation peak of the resonances over the mass range. As seen the amplitude variation is within the error, indicating as well that the nanomembrane detector is not limited in range by the mass. c, Separation of molecule ion and matrix adduct ion. Absolute resolution: two ions arrive at the detector with a temporal difference shorter than the ring-down time of the nanomembrane resonator was separated. d, With the width of the first peak of the oscillations defining the minimal temporal resolution, the mass resolution apparently increases towards higher masses.

FIG. 7*a* shows a comparison of the nanomembrane detector and a commercial multi-channel-plate (MCP) detector for the BSA spectrum. The molar concentration of the BSA is 10 μM. Both spectrums are calibrated to have a standard mass of BSA. The nanomembrane detector reveals many more resonances than the MCP under the same conditions, such as laser power and MCP bias. The additional resonances detected by the nanomembrane detector are attributed to fragment ions generated by the laser irradiation. The height and the width of the first peak of the resonances over the entire mass range remain constant with only small variations. FIG. 7*c* shows good separation between molecular ion and matrix adduct ion with a temporal difference corresponding to 241 Da, which is close to the mass of the sinapinic acid matrix (mass 224 Da). The nanomembrane detector can resolve two ion packets as long as they are separated by the width of the first peak even though the second ion packet arrives before the mechanical vibration excited by the first ion packet has ceased. Therefore, the time resolution of the nanomembrane detector can be defined by the width of the first peak through the paper. We estimate to achieve a lower concentration limit of any given analyte of below 100-fM, since the effective detector area can be maximized to larger than 6" and may be limited by the MCPs active cross section of typically 1.5".

In FIG. 7*b*, the normalized value of the first oscillation peak of the resonances is plotted over the mass range. As seen the amplitude variation is within the error, indicating as well that the nanomembrane detector is not limited in range by the mass.

In FIG. 7*c*, provide results for the separation of molecule ion and matrix adduct ion. Absolute resolution: two ions arrive at the detector with a temporal difference shorter than the ring-down time of the nanomembrane resonator was separated FIG. 7*d* shows a mass resolution with the widths of the first peak being the time resolution. With the width of the first peak of the oscillations defining the minimal temporal resolution, the mass resolution apparently increases towards higher masses.

Figure 10:
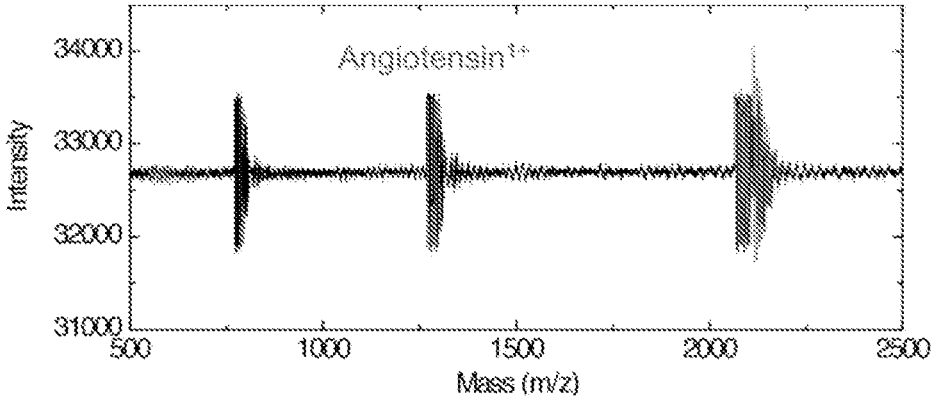
FIG. 10 provides a mass spectrum of Angiotensin obtained using the detection methods and detectors of the present invention.

FIG. 10 provides a mass spectrum of Angiotensin obtained using the detection methods and detectors of the present invention. The operating conditions for this measurement include: (1) Voltage between the nanomembrane and the extraction gate: 1.6 kV, (2) Acceleration voltage: 20 kV, (3) Matrix: α-cyano-4-hydroxycinnamic acid, (4) Nanomembrane thickness: 42 nm, (5) Thickness of the metal on both sides of the nanomembrane: 13 nm. This measurement further illustrates the dynamic range of the detectors and detection methods of the invention.

In conclusion, the present Example provides new methods and systems for ion detection in time of flight mass spectrometry, based upon the thermomechanical response of a nanomembrane to an impinging ion packet. The results of this example suggest that this mode of ion detection offers improved sensitivity in the mass analysis of large ions and complex protein mixtures.

Experimental Section

Methods.

A thin layer of silicon nitride ($Si_3N_4$, ~46 nm) is deposited on both sides of a silicon wafer (100) using low-pressure chemical vapor deposition (LPCVD). The membrane area is defined by optical lithography and reactive ion etching of $Si_3N_4$ on the backside of the silicon wafer. Finally, a square (25 $mm^2$) triple layer of $Al/Si_3N_4/Al$ is formed by anisotropic etching of the silicon wafer by potassium hydroxide (KOH) solution followed by metal sputtering (~13 nm) on both sides of the $Si_3N_4$ membrane. The nanomembrane was mounted in the Voyager DE STR and the measurements were carried out in delayed extraction mode. The proteins and matrix were purchased from Sigma Aldrich. The mixing of the modes was calculated using MATLAB Simulink. The mode shapes of the nanomembrane were calculated using COMSOL v3.3.

The electrostatic force applied by the extraction gate voltage causes two important consequences: first, it bulges the nanomembrane towards the extraction gate. Second, it supports emission of electrons from the nanomembrane, which is governed by Fowler-Nordheim field electron emission.

I. Displacement of the Nanomembrane Under Uniform Electrostatic Force

The displacement of the nanomembrane under uniform load can be expressed by [1]:

$$P(\zeta_{max}) = C_1 \frac{t\sigma}{a^2}\zeta_{max} + C_2(v)\frac{tE}{a^4}\zeta_{max}^3 \tag{S1}$$

where P is the pressure, $\zeta_{max}$ is the displacement at the center of the nanomembrane, E is Young's modulus, σ is the residual stress, v is the Poisson's ratio, t is the thickness of the nanomembrane, a is one half of the nanomembrane's length, and $C_1$ and $C_2(v)$ are numerical constants.

For small deformations, as described in the first term on right side, the displacement is proportional to the force and highly dependent upon the residual stress of the nanomembrane. However, for large deformations, as described in the second term on the right side, the displacement is proportional to the cube-root of the force and dominated by Young's modulus. Young's modulus of the $Al/Si_3N_4/Al$ tri-layer can be found by using the rule of mixtures:

$$E_{tri\text{-}layer}=E_{Al}\upsilon_{Al}+E_{Si_3N_4}(1-\upsilon_{A1}) \tag{S2}$$

where $\upsilon_{Al}$ is the volume fraction of Al layer.

Figure 4:
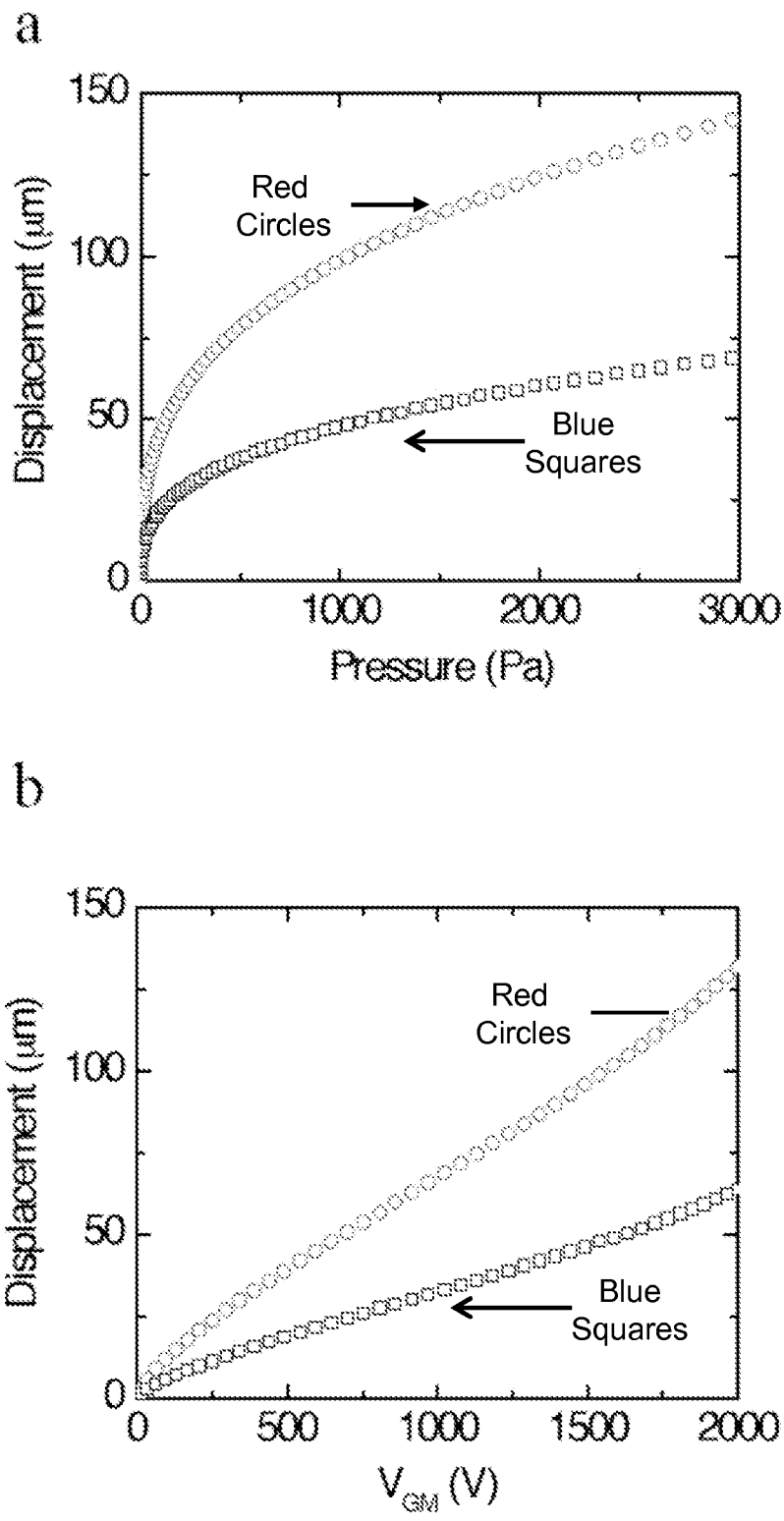

FIG. 4*a* shows a maximum (red circles) and an averaged (blue squares) displacement of the nanomembrane as a function of pressure. The pressure induced by the electrostatic force applied between the nanomembrane and the extraction gate can be given by:

$$P_e = \frac{F_e}{A} = \frac{\varepsilon_0 V_{GM}^2}{2d^2} \tag{S3}$$

where $\in_0$ is the vacuum permittivity, A is the area, and $V_{GM}$ and d are the voltage and the distance between the nanomembrane and the extraction gate, respectively.

In our particular case, as the nanomembrane deforms its shape, the displacement between the nanomembrane and the extraction gate changes continuously. Once the nanomembrane is deformed, the distance between the nanomembrane and the extraction gate becomes a function of position, $\zeta(x, y, V_{GM})$. The shape function of the deformed nanomembrane can be given by [1]:

$$\zeta(x, y, V_{GM}) = \zeta_{max}(V_{GM})\left(1 + 0.401\frac{x^2+y^2}{a^2} + 1.1611\frac{x^2y^2}{a^4}\right)\cos\frac{\pi x}{2a}\cos\frac{\pi y}{2a} \tag{S4}$$

where $\zeta_{max}$ is the displacement at the center of the nanomembrane, and a is one half of the nanomembrane's length.

The average displacement over the nanomembrane's surface can be given by:

$$\zeta_{ave}(V_{GM}) = \frac{\int_{-a}^{a}\int_{-a}^{a}\zeta(x, y, V_{GM})\,dx\,dy}{(2a)^2} \tag{S5}$$

The ratio of averaged and maximum displacement for a given pressure, α, can be found by:

$$\alpha = \frac{\zeta_{ave}(V_{GM})}{\zeta_{max}(V_{GM})} = 0.48375 \tag{S6}$$

Therefore, the distance between the nanomembrane and the extraction gate is:

$$d(V_{GM})=d_0-\zeta_{ave}(V_{GM})=d_0-\alpha\zeta_{max}(V_{GM}), \tag{S7}$$

where $d_0$=127 μm is the initial distance between the nanomembrane and the extraction gate.

Substituting equation (S7) into equation (S3) yields an equation for the pressure as a function of voltage applied between the nanomembrane and the extraction gate:

$$P_e = \frac{\varepsilon_0 V_{GM}^2}{2(d_0 - \alpha\zeta_{max}(V_{GM}))^2}. \tag{S8}$$

Therefore, the pressure can be converted into the voltage applied between the nanomembrane and the extraction gate, $V_{GM}$, as shown in FIG. S1*b*. The maximum static displacement (red circles) of 81.7 μm and the averaged static displacement (blue squares) of 39.5 μm were calculated for $V_{GM}$ at 1.25 kV.

II. Field Emission from Deformed Nanomembrane.

A modified Fowler-Nordheim (FN) equation [2], which takes this shape function into account, can be found by substituting equation (S7) into the FN equation and expressed by:

$$I_{FN} = A\left(\frac{V_{GM}}{d(V_{GM})}\right)^2 \exp\left(\frac{-Bd(V_{GM})}{V_{GM}}\right), \tag{S9}$$

where A and B are material dependent constant.

Figure 5:
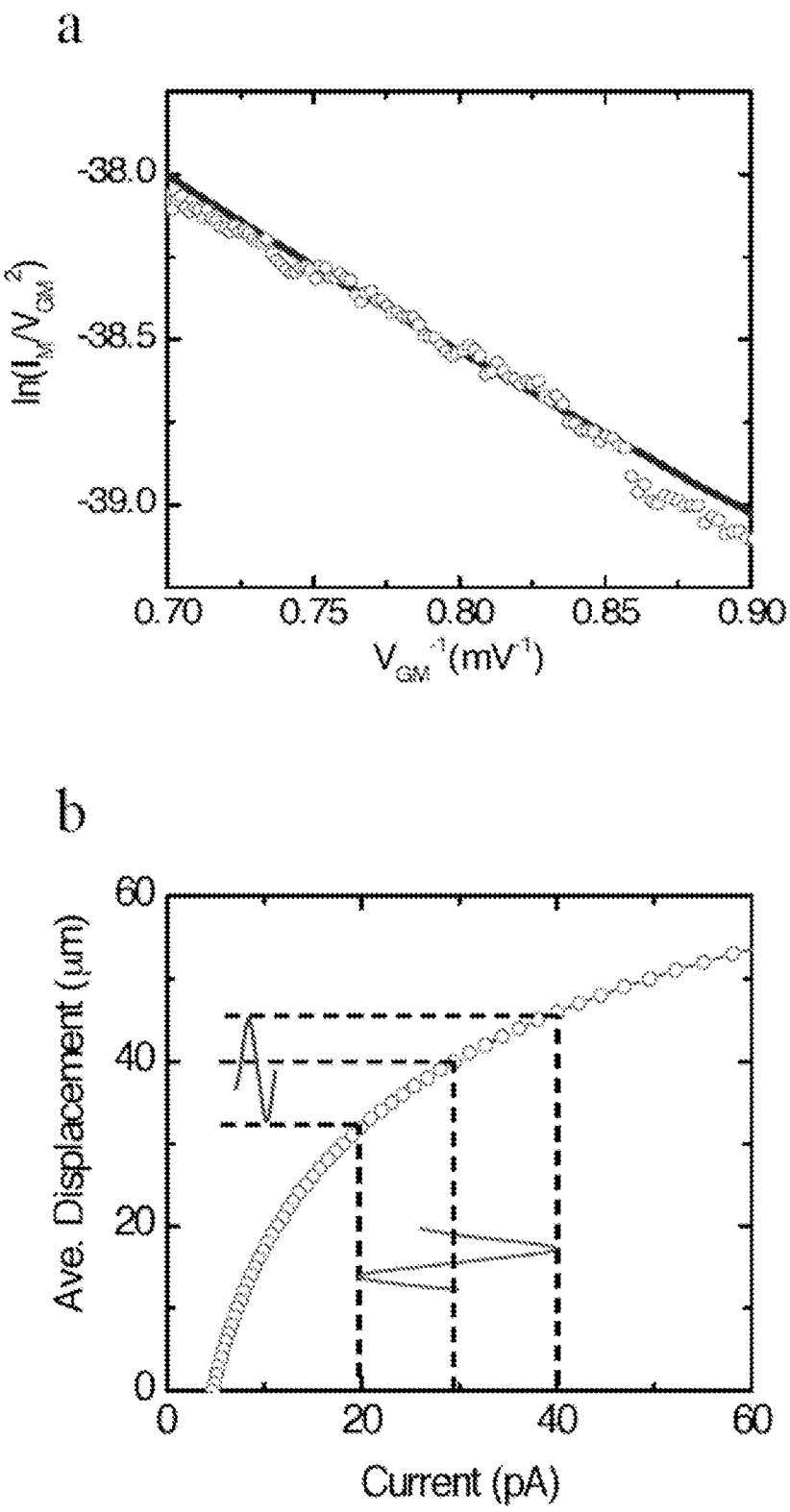
FIG. 5. Field emission current from the deformed nanomembrane. a, Measured field emission current $I_M$ vs. voltage between the nanomembrane and the extraction gate $V_{GM}$, plotted in Fowler-Nordheim (FN) representation (red dots), is fitted according to the modified FN equation (S9). b, Averaged displacement of the nanomembrane as a function of field emission current with $V_{GM}$ set at 1.25 kV. Modulation of the field emission current (red wave) can be mapped into the modulation of the averaged displacement (blue wave). The averaged dynamic displacement of +6.5 μm and −7.7 μm with respect to the averaged static displacement of 39.5 μm were calculated using equation (S9).

FIG. 5*a* shows a measured field emission current from the deformed nanomembrane plotted in Fowler-Nordheim representation (red dots). The blue line represents the calculated field emission current according to the modified FN equation given in equation (S9) and shows good agreement with the measured field emission current. The field emission current of 29.15 pA was observed for $V_{GM}$ of 1.25 kV.

III. Dynamic Displacement of the Nanomembrane

The maximum and minimum of the insulin peak in FIG. 3*a* are 21.7 mV and −18.7 mV, respectively. The field emission current to yield this level of voltage across the load resistor with the MCP gain can be found by $$I_{FN} = \frac{V}{R_{load} \times \text{Gain}_{MCP}}, \tag{S10}$$

where $I_{FN}$ is the field emission current, V is the voltage measured, $R_{load}$ is the load resistance, and $\text{Gain}_{MCP}$ is the gain of the MCP.

These result in a maximum of 40 pA and a minimum of 19.8 pA for the field emission current with the potentiometer resistance of 2 kΩ, the input impedance of the oscilloscope of 1 MΩ, and the MCPs gain of $10^6$. The distance between the nanomembrane and the extraction gate yielding this level of field emission current can be found by using equation (S9) with a $V_{GM}$ set at 1.25 kV. The averaged dynamic displacements of the nanomembrane were found to be +6.5 μm and −7.7 μm with respect to the averaged static displacement of 39.5 μm, as shown in FIG. 5*b*.

As DC Field

IV. Mechanical Vibration of the Nanomembrane.

The vibration modes of the nanomembrane, $\zeta_{i,j}(t)$, can be described by harmonic oscillators with the characteristic frequencies $\omega_{i,j}$, damping factor $k_{i,j}$, and external force f(t):

$$\ddot{\zeta}_{i,j} + 2k_{i,j}\omega_{i,j}\dot{\zeta}_{i,j} + \omega_{i,j}^2\zeta = f(t), \tag{S11}$$

where the characteristic frequencies, $f_{i,j}$ are:

$$f_{i,j} = \frac{1}{2l}\sqrt{\frac{T(i^2 + j^2)}{\rho h}}, \tag{S12}$$

where T is tension per unit length, ρ is density, h is thickness, and i and j are integer values. The four dominant mode frequencies obtained from the FFT spectrum are: $f_{2,2}$=3.65 MHz, $f_{4,4}$=7.52 MHz, $f_{5,5}$=8.94, and $f_{7,7}$=12.05 MHz. The fundamental mode with the characteristic frequency, $f_{1,1}$=1.825 MHz, can be derived from equation [2]. This fundamental mode is overdamped due to the applied electrostatic force. The indications for the overdamped fundamental mode can be found in the time domain traces of FIGS. 3*b* and 3*c*. In FIG. 3*c*, the second peak amplitude, labeled as ▼, is higher when compared to the first peak amplitude, labeled as ♦, indicating that the amplitudes are modulated by a lower frequency mode. However, the envelope of the peaks then decays to equilibrium without oscillating as shown in FIG. 3*b*. The overall envelope shape resembles a typical response of overdamped harmonic oscillators.

We consider the force induced by ion bombardments with normalized Gaussian function, which can be expressed by:

$$f(t) = \frac{1}{\sigma\sqrt{2\pi}}\exp\left(-\frac{(t-\mu)^2}{2\sigma^2}\right), \tag{S13}$$

where σ is the standard deviation, μ is the mean.

Solving equation (S11) with three dominant mode frequencies, $\omega_{1,1}$*, $\omega_{4,4}$, and $\omega_{7,7}$, separately using Matlab Simulink yields results for $\zeta_{1,1}$*(t), $\zeta_{4,4}$(t), and $\zeta_{7,7}$(t). (* indicates overdamped oscillations). Mixing of these three modes yields not only superposition of modes but also superposition of the product of each mode with different weights. Therefore, ζ(t) can be given by:

$$\zeta(t)=a\zeta_{1,1}^*(t)+b\zeta_{4,4}(t)+c\zeta_{1,1}^*(t)\zeta_{4,4}(t)+d\zeta_{7,7}(t)+e\zeta_{1,1}^*(t)\zeta_{7,7}(t)+f\zeta_{4,4}(t)\zeta_{7,7}(t)+g \tag{S14}$$

where a, b, c, d, e and f are numerical constants and g is the DC component.

It should be noted that $\zeta_{7,7}$(t) and $\zeta_{1,1}$*(t) $\zeta_{t,t}$(t) as well as $\zeta_{4,4}$(t) and $\zeta_{1,1}$*(t)$\zeta_{4,4}$(t) cannot be distinguished due to the phase noise and low value of $f_{1,1}$*. As shown in FIG. 3*e*, the maximum amplitude of the overdamped fundamental mode coincides with the second peak of the most dominant mode, θ, resulting in a higher second peak amplitude, labeled as ∇, when compared to the first peak amplitude, labeled as ◇, The envelope of the most dominant mode, θ, decays exponentially without oscillating due to modulation by the overdamped fundamental mode.

References

[1] Fenn, J. B., Mann, M., Meng, C. K., Wong, S. F. & Whitehouse, C. M. Electrospray ionization for mass spectrometry of large biomolecules. *Science* 246, 64-71 (1989).

[2] Tanaka, K. et al. Protein and polymer analyses up to m/z 100,000 by laser ionization time-of-flight mass spectrometry. *Rapid Commun. Mass Spectrom.* 2, 151-153 (1988).

[3] Karas, M. & Hillenkamp, F. Laser desorption ionization of protein with molecular masses exceeding 10,000 Daltons. *Anal. Chem.* 60, 2299-2301 (1988).

[4] Geno, P. W. Ion detection in MS. In: *Mass Spectrometry in the Biological Sciences: A Tutorial*. Kluwer Academic Publ., Netherlands, (1992).

[5] Wiley, W. C. & Mclaren, I. H. Time-of-flight mass spectrometry with improved resolution. *Rev. Sci. Instrum.* 26, 1150-1157 (1955).

[6] Chen, X., Westphall, M. S. & Smith, L. M. Mass spectrometric analysis of DNA mixtures: Instrumental effects responsible for decreased sensitivity with increasing mass. *Anal. Chem.* 75, 5944-5952 (2003).

[7] Geno, P. W. & Macfarlane, R. D. Secondary electron emission induced by impact of low-velocity molecular ions on a microchannel plate. *Int. J. Mass Spectrom. Ion Processes* 92, 195-210 (1989).

[8] Westmacott, G., Frank, M., Labov, S. E. & Benner, W. H. Using a superconducting tunnel junction detector to measure the secondary electron emission efficiency for a microchannel plate detector bombarded by large molecular ions. *Rapid Commun. Mass Spectrom.* 14, 1854-1861 (2000).

[9] Westmacott, G., Ens, W. & Standing, K. G. Secondary ion and electron yield measurements for surfaces bombarded with large molecular ions. *Nucl. Instrum Methods Phys. Res. B* 108, 282-289 (1996).

[10] Beuhler, R. J. & Friedman, L. Threshold studies of secondary electron emission induced by macro-ion impact on solid surfaces. *Nucl. Instrum. Methods* 170, 309-315 (1980).

[11] Meier, R. & Eberhardt, P. Velocity and ion species dependence of the gain of microchannel plates. *Int. J. Mass Spectrom. Ion Processes* 123, 19-27 (1993).

[12] Hilton, G. C. et al. Impact energy measurement in time-of-flight mass spectrometry with cryogenic microcalorimeters. *Nature* 391, 672-675 (1998).

[13] Twerenbold, D. et al. Single molecule detector for mass spectrometry with mass independent detection efficiency. *Proteomics* 1, 66-69 (2001).

[14] Esposito, E., Cristiano, R., Pagano, S., Perez de Lara, D. & Twerenbold, D. Fast Josephson cryodetector for time of flight mass spectrometry. *Physica C* (The Netherlands) 372/376, 423-426 (2002).

[15] Gervasio, G. et al. Aluminum junctions as macromolecule detectors and comparision with ionizing detectors. *Nucl. Instrum. Methods Phys. Res. A* 444, 389-394 (2000).

[16] Frank, M., Labov, S. E., Westmacott, G. & Benner, W. H. Energy-sensitive cryogenic detectors for high-mass biomolecule mass spectrometry. *Mass Spectrom. Rev.* 18, 155-186 (1999).

[17] Ekinci, K. L., Huang, X. M. H. & Roukes, M. L. Ultrasensitive nanoelectromechanical mass detection. *Appl. Phys. Lett.* 84, 4469-4471 (2004).

[18] Yang, Y. T., Callegari, C., Feng, X. L., Ekinci, K. L. & Roukes, M. L. A self-sustaining ultrahigh-frequency nanoelectromechanical oscillator. *Nature Nanotech.* 3, 342-346 (2008).

[19] Cleland, A. N. Thermomechanical noise limits on parametric sensing with nanomechanical resonators. *New J. Phys.* 7, 235 (2005).

[20] Ekinci, K. L., Yang, Y. T. & Roukes, M. L. Ultimate limits to inertial mass sensing based upon nanoelectromechanical systems. *J. Appl. Phys.* 95, 2682-2689 (2004).

[21] Lassagne, B., Garcia-Sanchez, D., Aguasca, A. & Bachtold, A. Ultrasensitive mass sensing with a nanotube electromechanical resonator. *Nano Lett.* 8, 3735-3783 (2008).

[22] Jensen, K., Kim, K. & Zettl, A. An atomic-resolution nanomechanical mass sensor. *Nature Nanotech.* 3, 533-537 (2008).

[23] Chiu, H.-Y., Hung, P., Postma, H. W. C. & Bockrath, M. Atomic-scale mass sensing using carbon nanotube resonators. *Nano Lett.* 8, 4342-4346 (2008).

[24] Naik, A. K., Hanay, M. S., Hiebert, W. K. Feng, X. L. & Roukes, M. L. Towards single-molecule nanomechanical mass spectrometry. *Nature Nanotech.* 4, 445-450 (2009).

[25] Fowler, R. H. & Nordhein, L. Electron emission in intense electric fields. *Proc. R. Soc. London, Ser. A* 119, 173 (1928).

[26] Sato, T., Ochiai, I., Kato, Y. & Murayama, S. Vibration of Beryllium foil window caused by plasma particle bombardment in plasma focus X-Ray source. *Jpn. J. Appl. Phys.* 30, 385-391 (1991).

[27] Landau, L. D. & Lifshitz, E. M. *THEORY of ELASTICITY.* 3rd edition. Pergamon press, New York (1986).

[1] Maier-Schneider, D., Maibach, J. & Obermeier, E., A new analytical solution for the load-deflection of square membranes. *J. MEMS.* 4, 238-241, (1995).

[2] Fowler, R. H. & Nordhein, L., Electron emission in intense electric fields, Proc. R. Soc. London, Ser. A 119, 173 (1928).

[3] MATLAB v7.10.0 R2010a.

EXAMPLE 2

Quasi-Dynamic Mode of Nanomembranes for Time-of-Flight Mass Spectrometry of Proteins Mechanical resonators realized on the nano-scale by now offer applications in mass-sensing of biomolecules with extraordinary sensitivity. The general idea is that perfect mechanical biosensors should be of extremely small size to achieve zepto-gram sensitivity in weighing single molecules similar to a balance. However, the small scale and long response time of weighing biomolecules with a cantilever restricts their usefulness as a high-throughput method. Commercial mass spectrometry (MS), such as electro-spray ionization (ESI)-MS and matrix-assisted laser desorption/ionization (MALDI)-time of flight (TOF)-MS are the gold standards to which nanomechanical resonators have to live up. These two methods rely on the ionization and acceleration of biomolecules and the following ion detection after a mass selection step, such as time-of-flight (TOF). Hence, the spectrum is typically represented in m/z, i.e. the mass to ionization charge ratio. In this Example, we demonstrate the feasibility and mass range of detection of a new mechanical approach for ion detection in time-of-flight mass spectrometry. The principle of which is that the impinging ion packets excite mechanical oscillations in a silicon nitride nanomembrane. These mechanical oscillations are henceforth detected via field emission of electrons from the nanomembrane. Ion detection is demonstrated in MALDI-TOF analysis over a broad range with angiotensin, bovine serum albumin (BSA), and an equimolar protein mixture of insulin, BSA, and Immunoglobulin G (IgG). The results show unprecedented mass range of operation of the nanomembrane detector.

Mass spectrometry is a system comprised of three major parts: an ionization source, which converts molecules to ions, a mass analyzer, which separates ions by their mass to charge ratio, and an ion detector. Mass spectrometry was revolutionized in the late 1980s by the invention of electrospray ionization (ESI)[1] and matrix-assisted laser desorption/ionization (MALDI)[2,3], which jointly provided means of generating ions from previously inaccessible large molecules such as proteins and peptides. Mass analyzer designs, such as the time-of-flight (TOF) methods, have since evolved to accommodate the large ions that are produced, providing dramatic improvements in performance. Mass spectrometry has become one of the most attractive methods for rapid identification and the classification of complex proteins. These tremendous improvements over the past decades helped to complete the genome sequencing.

In the most common method of mass spectrometry MALDI-TOF, molecules are first vaporized and typically singly or doubly ionized, before being accelerated in an electric field, and directed into a field-free drift tube where they separate by mass-to-charge ratio (m/z). Finally, the ions interact with a detector. Since the ions acquire the same kinetic energy when they are accelerated, their velocity and time of flight differs according to their m/z-ratio. The use of TOF mass analyzers provides an unlimited m/z-range and hence is particularly important for the mass analysis of large ions with low charge states produced with MALDI. Despite the essentially unlimited m/z-range of TOF, the m/z-range of mass spectrometers is limited by the detectors. In these conventional detectors ions are identified by secondary electron generation, such as in electron multipliers (EM) or micro-channel plates (MCP)[4]. The efficiency of these detectors is proportional to the velocity of the incident ion. In TOF mass spectrometry, ions with higher mass inherently have lower velocity, this leads to a decrease in ion detection efficiency for large ions[5-10]. Obviously, this creates a big demand for a detector with detection efficiency independent of ion velocity.

The ideal TOF detector fulfills the following criteria[11]: (1) it should have a large area, as the ion packets can have considerable spatial extent by the time they reach the end of the drift tube; (2) it should be fast in responding to the incoming ions and in order to provide the necessary timing resolution between ions as well as successive ion packets; (3) it should be sensitive, so that as few ions as possible can be detected; and (4) it should be compatible with existing mass spectrometer technology. In this Example we demonstrate the feasibility of an unconventional operating principle of nanomechanical systems for mass spectrometry, namely to measure the impact of impinging biomolecules onto a nanomechanical system.

Mechanical systems typically interact with their environment either by (i) statically deforming their shape or (ii) in a dynamical fashion with an alteration of their resonance frequency or (iii) by the onset of oscillations, also labeled the quasi-dynamic mode. The fundamental idea of the static mode (i) is the transduction of the surface stress induced by intermolecular force into a displacement of the mechanical system, e.g. cantilever. As molecules are adsorbed on the cantilever surface, charge will be removed from or added to the bonds between the cantilever surface atoms depending on the electronegativity of the adsorbate molecules, i.e. electron donor or acceptor, with respect to the cantilever surface. The change of the charge density between the cantilever surface bonds decreases or increases the tensile surface stress, resulting in mechanically bending the cantilever[12]. This bending can be determined straight forwardly with a laser interferometer[13-15]. Fritz et al.[16] have first demonstrated the detection of DNA-strands using functionalized surface of cantilevers. Functionalization of a cantilever's surface can be achieved by immobilizing a monolayer of receptor molecules on one side of it. In a liquid environment, the cantilevers are then susceptible to spurious deflection caused by temperature changes and fluidic disturbances. Differential measurement, which is a simultaneous measurement of an in situ reference cantilever aligned with the sensor cantilever, can eliminate these environmental factors[15]. This mode of operation has demonstrated its unique ability for label-free detection of various bio-molecules and their interactions, but fails to meet the first two and the last criteria for mass spectrometer detectors.

In the dynamic mode (ii), the resonance frequency of the nanomechanical resonator, usually a cantilever or doubly clamped beam, is perturbed, e.g. by surface adsorption of molecules. This mode enables the measurement of masses with high sensitivity. The resonance frequency of nanomechanical resonators is connected to the effective mass of the resonator. As molecules are adsorbed on the resonator, the effective mass of the resonator increases, resulting in a resonance frequency shift. The relation between this shift and the mass change, assuming that the adsorbed mass is distributed evenly along the resonator, can be expressed by $$\Delta f = -\frac{f_0}{2m_0}\Delta m \tag{1}$$

where the $\Delta f$ is the shift in resonance frequency, $f_0$ is the resonance frequency, $m_0$ is the initial mass of the nanomechanical resonator, and $\Delta m$ is the change in mass. A detailed analysis of the responsivity function R(x), which is the ratio of the shift in resonance frequency $\Delta f$ to the change in mass $\Delta m$, as a function of position x, of the adsorbed mass along the beam can be performed[17]. This mode of operation has been demonstrated exceptional mass sensitivity in air or vacuum[17-25]. However, in liquid environment, viscosity severely degrades mass resolution and sensitivity. Burg et aL[26-28] eliminate viscosity damping by placing the solution inside a hollow resonator and have demonstrated weighing of single nanoparticles, single bacterial cells and biomolecules with sub-femtogram resolution. Biosensors in this mode of operation exhibit extraordinary sensitivity, but suffer from long response times.

The quasi-dynamic mode (ii) finally is based on the transduction of the kinetic energy of the bio-molecules bombarding the surface the nanomembrane into the mechanical oscillations[29]. As high-energy ion packets hit the nanomembrane, the kinetic energy is transformed into thermal energy. This raises the temperature in the vicinity of the impact site causing a non-uniform temperature gradient over the nanomembrane. This results in a force, which in turn leads to a thermal deformation and mechanical vibration of the nanomembrane. Unless a successive ion packet arrives, the vibration ceases, and eventually the nanomembrane falls back to its equilibrium position. The vibration of the nanomembrane can be detected by a position sensor[29], which is in our case by means of field emission[11]. The induced vibrations of the nanomembrane caused by the thermal gradient can be expressed by[30]

$$\rho h\ddot{\zeta} + D\Delta^2\zeta - F\Delta\zeta = \frac{-E\alpha}{3(1-2\sigma)}\nabla T \tag{2}$$

where $\zeta$ is the vertical displacement, $\rho$ is the density, h is thickness of the nanomembrane, $D=Eh^3/12(1-\sigma^2)$ is the flexure rigidity, E is Young's modulus, $\sigma$ is the Poisson ratio, F is the stretching force per unit length of the edge of the nanomembrane, $\alpha$ is the thermal expansion coefficient, and T is the temperature increase above a uniform ambient level.

The characteristic frequencies for the vibration of the nanomembrane, $f_{i,j}$ can be expressed by[30]

$$f_{i,j} = \frac{1}{2l}\sqrt{\frac{F(i^2+j^2)}{\rho h}} \tag{3}$$

where i and j are integer values, l is the side length of the nanomembrane, $\rho$ is the density, h is thickness, and F is the stretching force per unit length of the edge of the nanomembrane.

In an early experiment it was shown that the vibrations of Beryllium foil windows can be driven by plasma particle bombardment[29]. Recently, we successfully demonstrated ion detection using this mode of operation with a MALDI-TOF analysis of proteins[11]. The mass range investigated was in between 5,729 (insulin) up to 150,000 (Immunoglobulin G)

Dalton[11]. This mode of operation provides a convenient and practicable approach of sensing molecules by a nanomechanical sensor.

Figure 11:
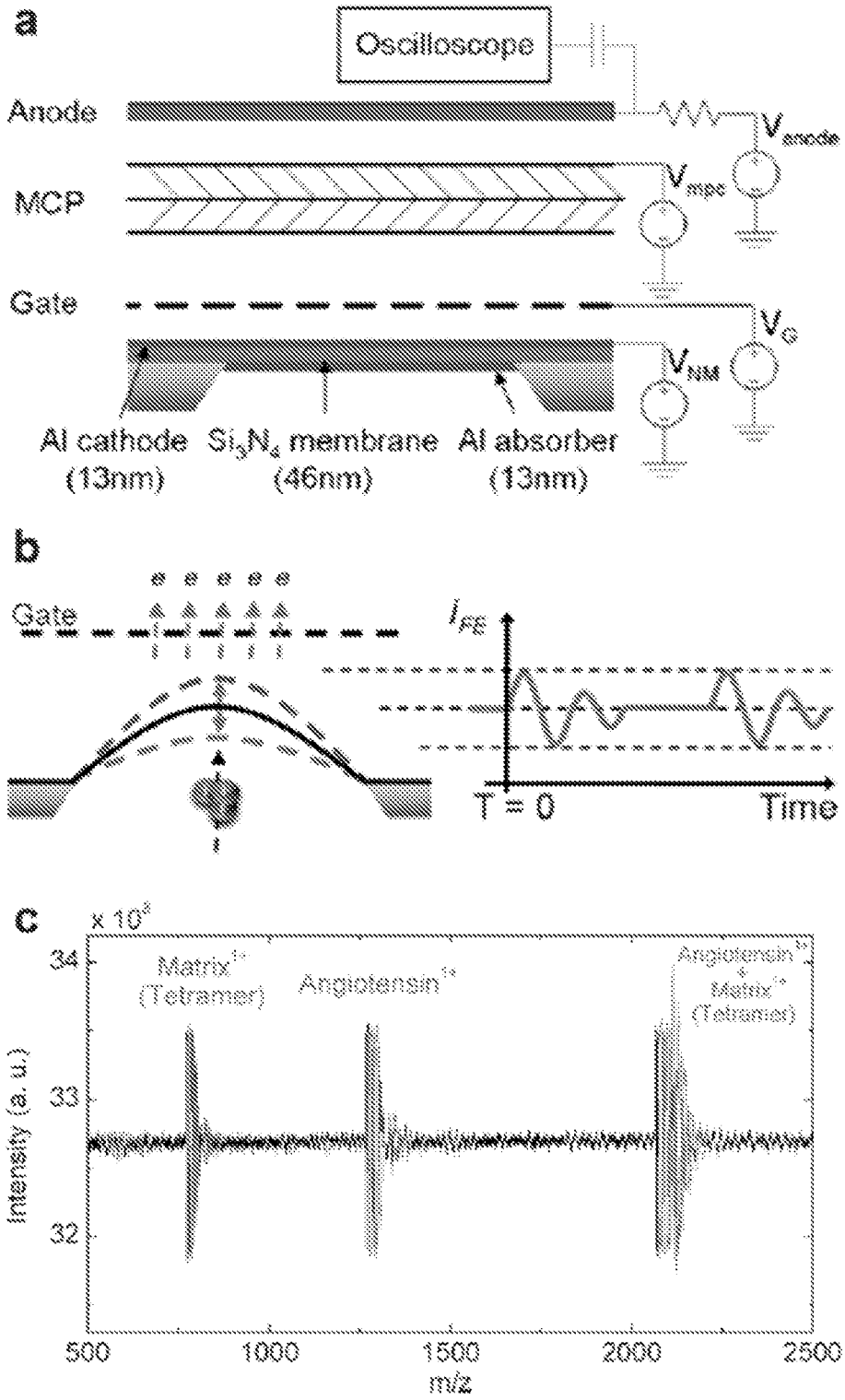
FIG. 11. Nanomembrane detector for time-of-flight mass spectrometry: a, Schematic of the detector configuration, consisting of a tri-layer made of $Al/Si_3N_4/Al$, an extraction gate, MCPs, and an anode. The oscilloscope allows real-time retrieval of the nanomembrane's mechanical oscillation. b, Detailed illustration of the operation principle of the detector. Ion bombardment excites the mechanical vibration of the nanomembrane, resulting in a modulation of the field emission current. c, Mass spectrum for angiotensin with an α-Cyano-4-hydroxycinnamic acid matrix, showing signal peak for singly charged angiotensin, the tetramer of matrix, and the tetramer of matrix adduct angiotensin ion.

As mentioned above our approach to mass spectrometry is based upon the quasi-dynamic mode of operation of large cross-section nanomembranes. In FIG. 11*a* the detector composition is shown consisting of four parts: a nanomembrane, an extraction gate, an MCP, and an anode. In the present work this detector is placed at the end of the flight tube in a commercial MALDI-TOF mass spectrometer (Perseptive Biosystems Voyager-DE STR). The square nanomembrane with a cross sectional area of 5×5-mm$^2$ is composed by a suspended tri-layer of Al/$Si_3N_4$/Al. The metal layers on top and below the $Si_3N_4$ act as a cathode for electron emission and absorber of incident ions, respectively. The fabrication of the suspended tri-layer nanomembrane is as follows: a thin layer of silicon nitride ($Si_3N_4$, 42~46 nm) is deposited on both sides of a silicon wafer (100) using low-pressure chemical vapor deposition (LPCVD). The membrane area is defined by optical lithography and reactive ion etching of $Si_3N_4$ on the backside of the silicon wafer. Finally, a square (5×5 mm$^2$) triple layer of Al/$Si_3N_4$/Al is formed by anisotropic etching of the silicon wafer by potassium hydroxide (KOH) solution followed by metal sputtering (~13 nm) on both sides of the $Si_3N_4$ membrane. The principle of operation of the detector is illustrated in FIG. 11*b*: with the voltage applied between the nanomembrane and the extraction gate, mechanical vibrations of the nanomembrane excited by ion bombardment translate into corresponding oscillation in the field emission current. The modulated field emission current is then amplified by the MCP and collected by the anode before being recorded on the oscilloscope. In addition to the force, which is induced by the ion bombardment, the DC voltage applied between the nanomembrane and the extraction gate will induce the electrostatic force. The vibrations and the deformation due to the thermal force and DC voltage can be expressed by $$\rho h\ddot{\zeta} + D\Delta^2\zeta - F\Delta\zeta = \frac{-E\alpha}{3(1-2\sigma)}\nabla T - \frac{1}{2}V^2\frac{dC}{d\zeta} \tag{4}$$

where V and C are the voltage and capacitance between the nanomembrane and the extraction gate, respectively.

FIG. 11*c* shows a MALDI mass spectrum obtained using the nanomembrane detector for angiotensin (1,296 Dalton (Da)) in an α-Cyano-4-hydroxycinnamic acid matrix. The molar concentration of the angiotensin is 10 μM. In addition to the singly charged angiotensin peak, the tetramer matrix and the tetramer matrix adduct angiotensin peaks are observed at a time-of-flight of 26.5 μs and 43.5 μs, respectively. The voltage and distance between the nanomembrane and the extraction gate are set to 1.6 kV and 127 μm, respectively, while the acceleration voltage is set to 20 kV.

Figure 12:
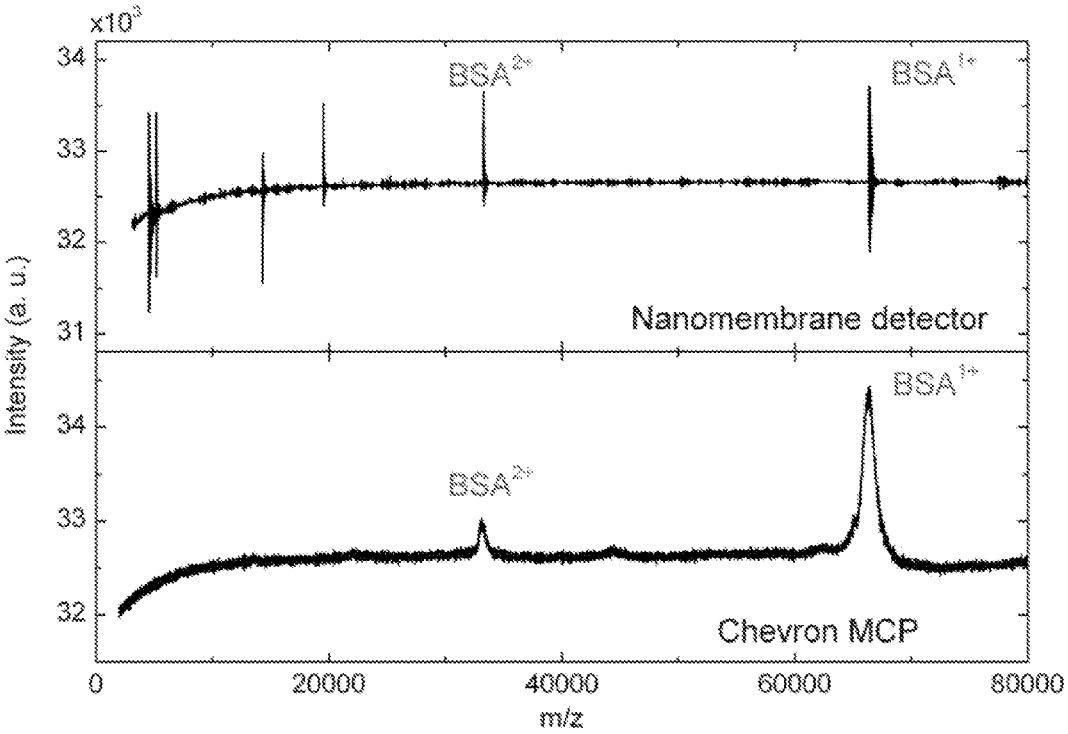
FIG. 12. Nanomembrane detector vs. MCP: Comparison of the nanomembrane detector (upper panel) and a commercial multi-channel plate (MCP) detector (lower panel) for BSA. The nanomembrane detector 'sees' more resonance than the MCP under same conditions such as laser power. The additional peaks are attributed to fragment ions or neutrons.

In order to compare a conventional MCP to the nanomembrane detector, we measured the same spectra and swapped the two detectors in the same MALDI-TOF unit. The result is shown in FIG. 12: the upper panel gives the nanomembrane detector's response, while the lower panel shows the same BSA spectrum traced with a chevron MCP detector. The molar concentration of the BSA is 10 μM. Both spectra are calibrated to have a standard mass of BSA when the time of flight is converted to the corresponding m/z. The nanomembrane detector 'sees' more peaks than the MCP under the same conditions such as laser power and MCP bias. The additional resonances are only detected by the nanomembrane detector and can be attributed to either fragment ions generated in the MALDI process or during the TOF transition. If the proteins fragment within the TOF-unit, it is possible that the nanomembrane can 'see' uncharged molecules, typically labeled as neutrals. The resonance frequency of the most dominant mode was found to be ~18.8 MHz (with voltage between the nanomembrane and the extraction gate set to 1.7 kV and acceleration voltage set to 25 kV). The height of the resonances over the entire mass range of interest for angiotensin and BSA remains constant with only small variations as shown in FIGS. 11*c* and 12.

In order to test the nanomembrane detector with a more complex protein mixture we use an equimolar protein mixture (3.3 μM each) of insulin (5,729 Da), BSA, and immunoglobulin G (IgG, ~150,000 Da) in a sinapinic acid matrix. FIG. 13*a* shows the resulting MALDI mass spectrum obtained using our nanomembrane detector with the voltage between the nanomembrane and the extraction gate set to 1.25 kV and an acceleration voltage of 20 kV. In addition to the three singly charged insulin, BSA, and IgG peaks, additional peaks are revealed. We speculate that these are fragment ions or neutrals generated in the MALDI-TOF unit.

FIG. 13*b* shows the expanded regions for insulin, BSA, and IgG peaks in the sub-microsecond range. On this time scale the mechanical vibrations of the nanomembrane can be clearly resolved. With the appearance of the first peak (labeled as ∇) enough energy is transferred to cause the onset of mechanical oscillations. FIG. 13*c* shows the height of the first peak (labeled as ∇ in FIG. 13*b*) for each protein (dots) and their linear regression (line). The height of the first peak of insulin, BSA and IgG is normalized to the height of first peak of insulin. As seen, the normalized peak height is reduced only slightly at higher masses (less than 20% up to 150 kDa). The inset shows the extrapolation of a linear regression to zero intensity in log-scale and indicates that the upper mass limit of the detector is found to be 1.5 MDa. An interesting aspect of this detector is the fact that the height of the peak is not highly dependent upon the m/z value. These features of the nanomembrane detector offer potential for improved performance in the analysis of large molecules.

Figure 13:
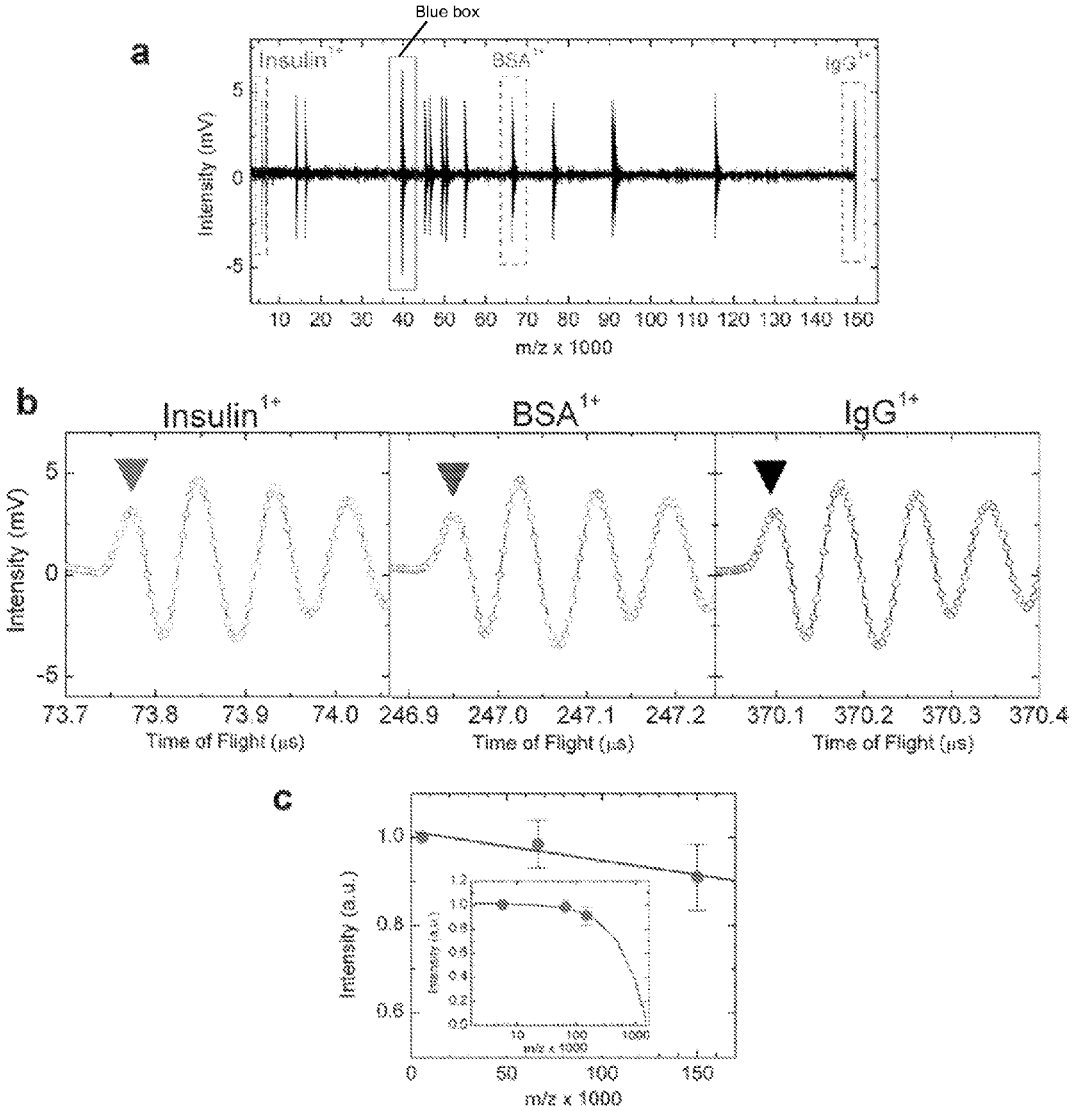
FIG. 13. Mass spectrum for an equimolar protein mixture: a, Mass spectrum for an equimolar protein mixture of insulin, BSA and IgG with a sinapinic acid matrix. In addition to the singly charged insulin, BSA and IgG, additional peaks, which are attributed to fragment ions or neutrons, are also detected. b, Individual traces of the nanomembrane detector response for insulin, BSA, and IgG in sub-microsecond time scale. Each trace clearly shows a mechanical vibration of the nanomembrane. c, The height of the first peak (red dots) for each protein. The height of first peak for each protein is normalized by the first peak height of the insulin, showing only slight decreases as mass increases. The inset shows the upper mass limit of the nanomembrane detector, which is found to be 1.5 MDa.
Figure 14:
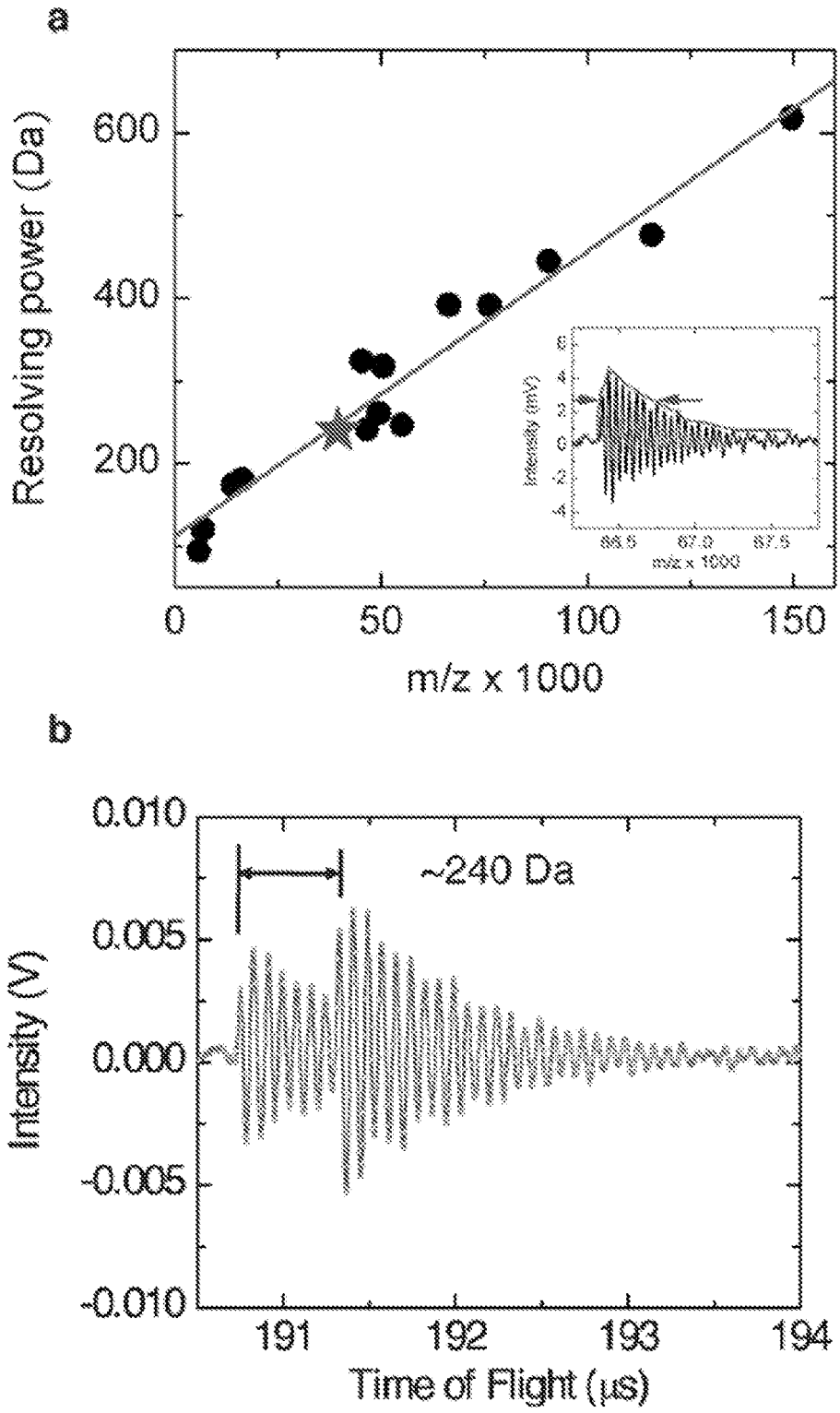
FIG. 14. Resolving power of the nanomembrane detector: a, resolving power (FWHM of the envelope of the oscillations in FIG. 13*a*) of the nanomembrane (black circles) and their regression (red line). The inset shows the envelope (red line) and FWHM (blue arrows) of the oscillations. b, A magnified view of the peak enclosed in blue (solid line) box in FIG. 13*a* and showing separation of two different ion packet which arrive at the detector with a temporal difference shorter than the relaxation time of the nanomembrane detector. The corresponding mass difference between two ions is 240 Da and agrees well with the predicted resolving power of 248 as shown in FIG. 14*a* (blue star).

In order to examine the resolving power (Δm), we use the full-width-at-half-maximum (FWHM) of the envelope of the oscillations as a definition for Δm, as indicated by the two arrows in the inset of FIG. 14*a*. It shows the expanded region of the BSA peak along with the envelope (red line) and FWHM (blue arrows) of the oscillations. FIG. 14*a* shows this resolving power of the nanomembrane detector (black circles) and their linear regression (red line) over the mass range from 5 kDa to 150 kDa. In order to test the validity of our definition of the resolving power, we now focus on an expanded region of the detector's response. FIG. 14*b* shows the expanded region of the peak, which is enclosed in the blue box in FIG. 13*a*. It demonstrates the separation of two ion packets with m/z of 39,533 and 39,773 Da arriving at the detector with a temporal difference corresponding to ~240 Da. This resolving power of 240 Da is labeled by a * in FIG. 14*a*. It directly matches the linear regression of resolving power obtained from the data. It should be noted that the FWHM of the oscillations is highly dependent on the relaxation time, which in turn is determined by the mechanical properties of the nanomembrane. Therefore, the resolving power can be strongly improved by exciting higher order modes of oscillations, which dissipates its energy quickly.

Figure 15:
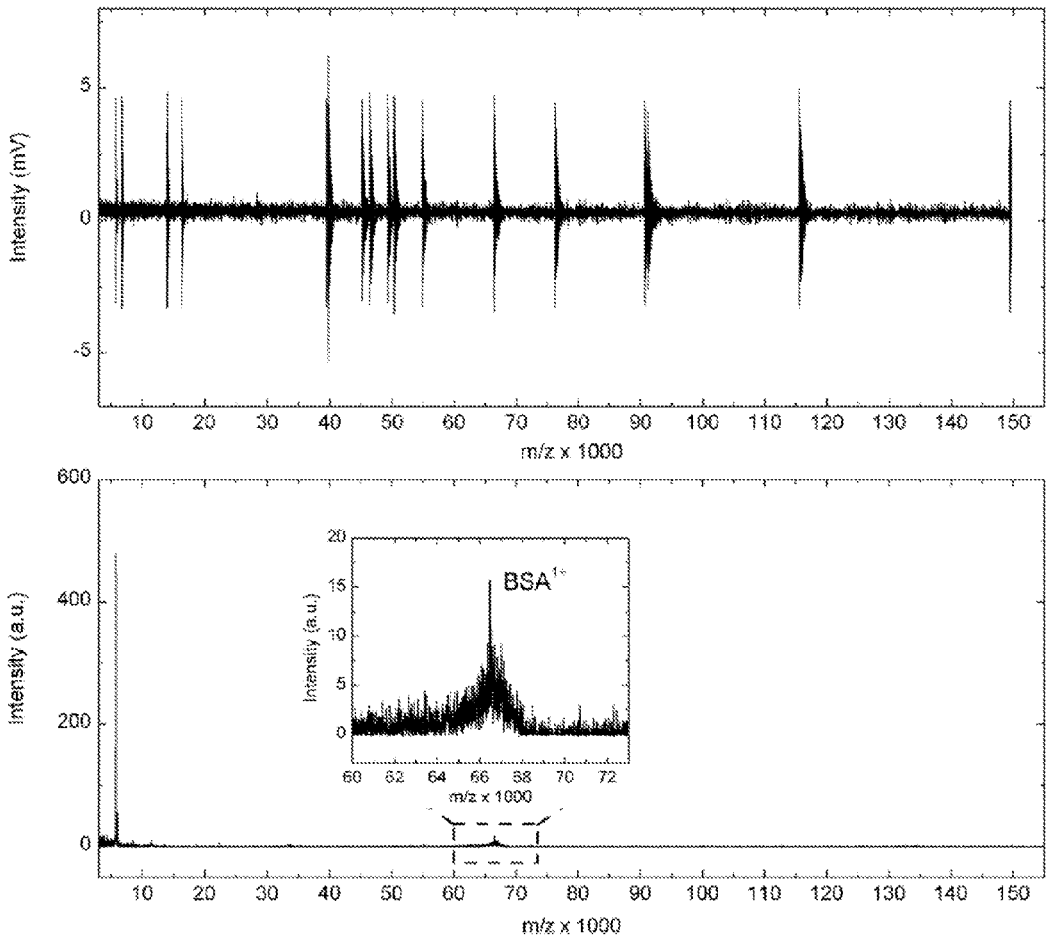
FIG. 15. Comparison of the nanomembrane detector and a commercial detector: MALDI TOF analysis of the protein mixture used in FIG. 13 using the nanomembrane detector (top panel) and a commercial detector (bottom panel). The commercial detector suffers for the analysis for large m/z ion mixture, while the nanomembrane detector shows a rich ion spectrum over the entire mass range.

FIG. 15 shows the comparison of the nanomembrane detector (top panel) and a commercial detector (bottom panel) for the MALDI analysis of the protein mixture originally used in FIG. 13. The commercial detector consists of a chevron MCP, a phosphor screen, and a photomultiplier tube. The mass spectrum obtained using the commercial detector shows the limitation of the conventional detector for the analysis of large m/z mixture ions, where detector saturation effects come in to play. The MCP detector barely shows the BSA peak and cannot reveal the IgG, while the nanomembrane detector provides a rich spectrum.

In conclusion, this Example demonstrates an unprecedented mass range delivered by nanomembrane detectors operating in the quasi-dynamic mode. This extremely broad mass range lends itself for the analysis of large ions with a mass to above 1 MDa. The detector can be readily applied to commercial mass spectrometry, as we have shown.

References

1. Fenn, J. B., Mann, M., Meng, C. K. & Wong, S. F. Electrospray ionization for mass spectrometry of large biomolecules. Science 246, 64-71 (1989).
2. Tanaka, K., Waki, H., Ido, Y., Akita, S., Yoshida, Y., Yoshida, T. & Matsuo, T. Protein and polymer analyses up to m/z 100,000 by laser ionization time-of-flight mass spectrometry. Rapid Commun. Mass Spectrom. 2, 151-153 (1988).
3. Karas, M. & Hillenkamp, F. Laser desorption ionization of protein with molecular masses exceeding 10,000 Daltons. Anal. Chem. 60, 2299-2301 (1988).
4. Geno, P. W. Ion detection in MS. In: Mass Spectrometry in the Biological Sciences: A Tutorial. Kluwer Academic Publ., Netherlands, (1992).
5. Chen, X., Westphall, M. S. & Smith, L. M. Mass spectrometry analysis of DNA mixtures: Instrumental effects responsible for decreased sensitivity with increasing mass. Anal. Chem. 75, 5944-5952 (2003).
6. Geno, P. W. & Macfarlane, R. D. Secondary electron emission induced by impact of low velocity molecular ions on a microchannel plate. Int. J. Mass Spectrom. Ion Processes 92, 195-210 (1989).
7. Westmacott, G., Frank, M., Labov, S. E. & Benner, W. H. Using a superconducting tunnel junction detector to measure the secondary electron emission efficiency for a microchannel plate detector bombarded by large molecular ions. Rapid Commun. Mass Spectrom. 14, 1854-1861 (2000).
8. Westmacott, G., Ens, W. & Standing, K. G. Secondary ion and electron yield measyrements for surfaces bombarded with large molecular ions. Nucl. Instrum Methods Phys. Res. B 108, 282-289 (1996).
9. Beuhler, R. J. & Friedman, L. Threshold studies of secondary emission induced by macro-ion impact on solid surfaces. Nucl. Instrum. Methods 170, 309-315 (1980).
10. Meier, R. & Eberhardt, P. Velocity and ion species dependence of the gain of microchannel plates. Int. J. Mass Spectrom. Ion Processes 123, 19-27 (1993).
11. Park, J., Qin, H., Scalf, M., Hilger, R. T., Westphall, M. S., Smith, L. M. & Blick, R. H. A mechanical nanomembrane detector for time-of-flight mass spectrometry. Nano lett. 11, 3681-3684 (2011).
12. Ibach, H. The role of surface stress in reconstruction, epitaxial growth and stabilization of mesoscopic structures. Surf. Sci. Reports 29, 195-263 (1997).
13. Mourlin, A. M., O'Shea, S. J., Badley, R. A., Doyle, P. & Welland, M. E. Measuring Surface-Induced Conformational Changes in Proteins. Langmuir 15, 8776 (1999).
14. Baller, M. K., Lang, H. P., Fritz, J., Gerber, C., Gimzewsk, J. K., Drechsler, U., Rothuizen, H., Despont, M., Vettiger, P., Battiston, F. M., Ramseyer, J. P., Formaro, P., Meyer, E. & Guntherodt, H. J. A cantilever array-based artificial nose. Ultramicroscopy 82, 1 (2000).
15. Backmann, N., Zahnd, C., Huber, F., Bietsch, A., Pluckthun, A., Lang, H., Guntherodt, H., Hegner, M. & Gerber, C. A label-free immunosensor array using single-chain antibody fragments. Proc. Natl Acad. Sci. USA 102, 14587-14952 (2005).
16. Fritz, J., Bailer, M. K., Lang, H. P., Rothuizen, H., Vettiger, P., Meyer, E., Guntherodt, H. -J., Gerber, Ch. & Gimzewski, J. K. Translating biomolecular recognition into nanomechanics, Science, 288, 316-318 (2000).
17. Jensen, K., Kim, K. & Zettl, A. An atomic-resolution nanomechanical mass sensor. Nature nanotech. 3, 533-537 (2008).
18. Thundat, T., Wachter, E. A., Sharp, S. L. & Warmack, R. J. Detection of mercury vapor using resonating microcantilevers. Appl. Phys. Lett. 66, 1695-1697 (1995).
19. Lange, D., Hagleitner, C., Hierlemann, A., Brand, O. & Baltes, H. Complementary metal oxide semiconductor cantilever arrays on a single chip: mass-sensitive detection of volatile organic compounds. Anal. Chem. 74, 3084-3095 (2002).
20. Lavrik, N. V. & Datskos, P. G. Femtogram mass detection using photothermally actuated nanomechanical resonators. Appl. Phys. Lett. 82, 2697-2699 (2003).
21. Ono, T., Li, X., Miyashita, H. & Esashi, M. Mass sensing of adsorbed molecules in sub-picogram sample with ultrathin silicon resonator. Rev. Sci. Instrum. 74, 1240-1243 (2003).
22. Gupta, A., Akin, D. & Bashir, R. Single virus particle mass detection using microresonators with nanoscale thickness. Appl. Phys. Lett. 84, 1976-1978 (2004).
23. Ilic, B., Craighead, H. G., Krylov, S., Senaratne, W., Ober, C. & Neuzil, P. Attogram detection using nanoelectromechanical oscillators. J. Appl. Phys. 95, 3694-3703 (2004).
24. Forsen, E., Abadai, G., Ghatneka-Nilsson, S., Teva, J., Verd, J., Sandberg, R., Svendsen, W., Perez-Murano, F., Esteve, J., Figueras, E., Campabadai, F., Montelius, L., Barniol, N. & Boisen, A. Ultrasensitive mass sensor fully integrated with complementary metal-oxide-semiconductor circuitry. Appl. Phys. Lett. 87, 043507 (2005).
25. Ilic, B., Yang, Y. & Craighead, H. G. Virus detection using nanoelectromechanical devices. Appl. Phys. Lett. 85, 2604-2606 (2004).
26. Burg, T. P. & Manalis, S. R. Suspended microchannel resonators for biomolecular detection. Appl. Phys. Lett. 83, 2698-2700 (2003).
27. Burg, T. P., Mirza, A. R., Milovic, N., Tsau, C. H., Popescu, G. A., Foster, J. S. & Manalis, S. R. Vacuum-packaged suspended microchannel resonant mass sensor for biomolecular detection. J. Microelectromech. Syst. 15, 1466-1476 (2006).
28. Burg, T. P., Godin, M., Knudsen, S. M., Shen, W., Carlson, G., Foster, J. S., Babcock, K. & Manalis, S. R. Weighing of biomolecules, single cells and single nanoparticles in fluid. Nature 446, 1066-1069 (2007).
29. Sato, T., Ochiai, I., Kato, Y. & Murayama, S. Vibration of Beryllium foil window caused by plasma particle bombardment in plasma focus X-Ray source. Jpn. J. Appl. Phys. 30, 385-391 (1991).
30. Landau, L. D. & Lifshitz, E. M. THEORY of ELASTICITY. 3-rd edition. Pergamon press, New York (1986).

STATEMENTS REGARDING INCORPORATION BY REFERENCE AND VARIATIONS

All references throughout this application, for example patent documents including issued or granted patents or equivalents; patent application publications; and non-patent literature documents or other source material; are hereby incorporated by reference herein in their entireties, as though individually incorporated by reference, to the extent each reference is at least partially not inconsistent with the disclosure in this application (for example, a reference that is partially inconsistent is incorporated by reference except for the partially inconsistent portion of the reference).

U.S. Patent Publication Nos. US-2007-0023621 and 2010-0320372 relate to detectors for mass spectrometry having a nano- or microstructured membrane geometry and are hereby incorporated by reference.

The terms and expressions which have been employed herein are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments, exemplary embodiments and optional features, modification and variation of the concepts herein disclosed may be resorted to by those skilled in the art, and that such modifications and variations are considered to be within the scope of this invention as defined by the appended claims. The specific embodiments provided herein are examples of useful embodiments of the present invention and it will be apparent to one skilled in the art that the present invention may be carried out using a large number of variations of the devices, device components, methods steps set forth in the present description. As will be obvious to one of skill in the art, methods and devices useful for the present methods can include a large number of optional composition and processing elements and steps.

When a group of substituents is disclosed herein, it is understood that all individual members of that group and all subgroups, including any isomers, enantiomers, and diastereomers of the group members, are disclosed separately. When a Markush group or other grouping is used herein, all individual members of the group and all combinations and subcombinations possible of the group are intended to be individually included in the disclosure. When a compound is described herein such that a particular isomer, enantiomer or diastereomer of the compound is not specified, for example, in a formula or in a chemical name, that description is intended to include each isomers and enantiomer of the compound described individual or in any combination. Additionally, unless otherwise specified, all isotopic variants of compounds disclosed herein are intended to be encompassed by the disclosure. For example, it will be understood that any one or more hydrogens in a molecule disclosed can be replaced with deuterium or tritium. Isotopic variants of a molecule are generally useful as standards in assays for the molecule and in chemical and biological research related to the molecule or its use. Methods for making such isotopic variants are known in the art. Specific names of compounds are intended to be exemplary, as it is known that one of ordinary skill in the art can name the same compounds differently.

Many of the molecules disclosed herein contain one or more ionizable groups [groups from which a proton can be removed (e.g., —COOH) or added (e.g., amines) or which can be quaternized (e.g., amines)]. All possible ionic forms of such molecules and salts thereof are intended to be included individually in the disclosure herein. With regard to salts of the compounds herein, one of ordinary skill in the art can select from among a wide variety of available counterions those that are appropriate for preparation of salts of this invention for a given application. In specific applications, the selection of a given anion or cation for preparation of a salt may result in increased or decreased solubility of that salt.

Every formulation or combination of components described or exemplified herein can be used to practice the invention, unless otherwise stated.

Whenever a range is given in the specification, for example, a temperature range, a time range, or a composition or concentration range, all intermediate ranges and subranges, as well as all individual values included in the ranges given are intended to be included in the disclosure. It will be understood that any subranges or individual values in a range or subrange that are included in the description herein can be excluded from the claims herein.

All patents and publications mentioned in the specification are indicative of the levels of skill of those skilled in the art to which the invention pertains. References cited herein are incorporated by reference herein in their entirety to indicate the state of the art as of their publication or filing date and it is intended that this information can be employed herein, if needed, to exclude specific embodiments that are in the prior art. For example, when composition of matter are claimed, it should be understood that compounds known and available in the art prior to Applicant's invention, including compounds for which an enabling disclosure is provided in the references cited herein, are not intended to be included in the composition of matter claims herein.

Unless defined otherwise, all technical and scientific terms used herein have the same meanings as commonly understood by one of ordinary skill in the art to which this invention belongs. Although any methods and materials similar or equivalent to those described herein can be used in the practice or testing of the present invention, the preferred methods and materials are now described. Nothing herein is to be construed as an admission that the invention is not entitled to antedate such disclosure by virtue of prior invention.

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of" and "consisting of" may be replaced with either of the other two terms. The invention illustratively described herein suitably may be practiced in the absence of any element or elements, limitation or limitations which is not specifically disclosed herein.

It must be noted that as used herein and in the appended claims, the singular forms "a", "an", and "the" include plural reference unless the context clearly dictates otherwise. Thus, for example, reference to "a cell" includes a plurality of such cells and equivalents thereof known to those skilled in the art, and so forth. As well, the terms "a" (or "an"), "one or more" and "at least one" can be used interchangeably herein. It is also to be noted that the terms "comprising", "including", and "having" can be used interchangeably. The expression "of any of claims XX-YY" (wherein XX and YY refer to claim numbers) is intended to provide a multiple dependent claim in the alternative form, and in some embodiments is interchangeable with the expression "as in any one of claims XX-YY."

One of ordinary skill in the art will appreciate that starting materials, biological materials, reagents, synthetic methods, purification methods, analytical methods, assay methods, and biological methods other than those specifically exemplified can be employed in the practice of the invention without resort to undue experimentation. All art-known functional equivalents, of any such materials and methods are intended to be included in this invention. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

We claim:

1. A method of detecting analytes, the method comprising:

a) providing a detector comprising:

a membrane having a receiving surface for receiving the analytes, and an internal surface positioned opposite to the receiving surface, wherein the membrane is a material selected from the group consisting of a semiconductor, a metal and a dielectric material, and wherein the membrane has a thickness selected from the range of 5 nanometers to 50 microns;

a holder for holding the membrane, wherein said holder contacts said membrane at one or more contact points;

an extraction electrode positioned so as to establish an applied electric field on the internal surface of the membrane or an electron emitting layer provided on the internal surface of the membrane, thereby causing emission of electrons from the internal surface or the electron emitting layer; and an electron detector positioned to detect at least a portion of the electrons emitted from the internal surface or the electron emitting layer;

b) generating a non-uniform temperature distribution along a thickness dimension, lateral dimension, vertical dimension or any combination of these of the membrane by contacting the receiving surface with the analytes, thereby exciting a mechanical deformation of the membrane that modulates the emission of electrons from the internal surface of the membrane or the emitting layer; and c) detecting the electrons emitted from the internal surface of the membrane or the emitting layer.

2. The method of claim 1, wherein the non-uniform temperature distribution is along at least a portion of the thickness of the membrane.

3. The method of claim 1, wherein the non-uniform temperature distribution extends along one or more lateral dimensions, said vertical dimension or any combination of said lateral dimensions and said vertical dimension of the membrane.

4. The method of claim 1, wherein the non-uniform temperature distribution extends to said one or more contact points or a region of the membrane within 100 nanometers of a contact point.

5. The method of claim 1, wherein the non-uniform temperature distribution extends to one or more edges of the membrane.

6. The method of claim 1, wherein the non-uniform temperature distribution is greater than average thermal fluctuation at a temperature of 298 K.

7. The method of claim 1, wherein the non-uniform temperature distribution is characterized by a thermal gradient greater than or equal to 90K/nm.

8. The method of claim 1, wherein the non-uniform temperature distribution is characterized by a thermal gradient selected over the range of 90K/nm to 910K/nm.

9. The method of claim 1, wherein the non-uniform temperature distribution is characterized by an increase in temperature at a rate greater than or equal to $7.9\times10^{12}$K/sec.

10. The method of claim 1, wherein the non-uniform temperature distribution is characterized by an increase in temperature at a rate selected over the range of $7.9\times10^{12}$K/sec to $8.03\times10^{13}$K/sec.

11. The method of claim 1, wherein the non-uniform temperature distribution is characterized by a thermal gradient extending a distance of 3 nm to 50 μm along the thickness of the membrane.

12. The method of claim 1, wherein the membrane is an overdamped oscillator.

13. The method of claim 1, wherein the membrane is an overdamped harmonic oscillator.

14. The method of claim 1, further comprising measuring intensities of the electrons emitted from the emitting layer as a function of time, thereby generating a response signal characterized by one or more peaks at different times, wherein each peak is characterized by a maximum value.

15. The method of claim 14, further comprising the steps of: identifying the first peak in the response signal corresponding to an earliest time; and determining the maximum value corresponding to the first peak.

16. The method of claim 15, wherein the maximum value corresponding to the first peak is proportional to the amount of the analytes contacting the receiving surface of the membrane.

17. The method of claim 15, wherein the maximum value corresponding to the first peak is proportional to the kinetic energy of the analytes contacting the receiving surface of the membrane.

18. The method of claim 15, further comprising the step of determining a detection time corresponding to the maximum value corresponding to the first peak, wherein the detection time is proportional to a flight time of the analytes.

19. The method of claim 15, further comprising the step of determining a width of the first peak, wherein the width corresponds to a measurement of half of a period of a vibration of the membrane.

20. The method of claim 15, further comprising the step of determining a slope of the leading edge of the first peak, wherein the slope corresponds to a measurement of the amount of the analytes contacting the receiving surface and mass broadening due to an isotope distribution of the analytes.

21. The method of claim 1, wherein the membrane comprises a single crystalline material.

22. The method of claim 1, wherein the membrane comprises a material selected from the group consisting of Si, Ge, $Si_3N_4$, diamond, graphene, Al, Ga, In, As and any combinations thereof.

23. The method of claim 1, wherein the membrane or electron emitting layer generates the electrons by field emission.

24. The method of claim 1, wherein the analytes are ions derived from peptides, proteins. oligonucleotides, polysaccharides, lipids, carbohydrates, DNA molecules, RNA molecules, glycoproteins, lipoproteins or virus capsides.

25. A method of detecting ions, the method comprising:

a) providing a detector comprising:

a membrane having an receiving surface for receiving the ions, and an internal surface positioned opposite to the receiving surface, wherein the membrane is a material selected from the group consisting of a semiconductor, a metal and a dielectric, and wherein the membrane has a thickness selected from the range of 5 nanometers to 50 microns;

a holder for holding the membrane, wherein said holder contacts said membrane at one or more contact points;

an extraction electrode positioned so as to establish an applied electric field on the internal surface of the membrane or an electron emitting layer provided on the internal surface of the membrane, thereby causing emission of electrons from the internal surface or the electron emitting layer; and an electron detector positioned to detect at least a portion of the electrons emitted from the internal surface or the electron emitting layer;

b) passing the ions through a mass analyzer to achieve physical separation on the basis of mass-to-charge ratio;

c) generating a non-uniform temperature distribution along a thickness dimension, lateral dimension, vertical dimension or any combination of these of the membrane by contacting the receiving surface with the ions, thereby exciting a mechanical deformation of the membrane that modulates the emission of electrons from the internal surface of the membrane or the emitting layer;

d) detecting the electrons emitted from the internal surface of the membrane or the emitting layer;

e) measuring intensities of the electrons emitted from the internal surface of the membrane or the emitting layer as a function of time, thereby generating a response signal characterized by one or more peaks at different times, wherein each peak is characterized by a maximum value;

f) identifying a first peak corresponding to an earliest time; and g) determining the maximum value corresponding to the first peak.

* * * * *